US006734620B2

(12) United States Patent
Radigan et al.

(10) Patent No.: US 6,734,620 B2
(45) Date of Patent: May 11, 2004

(54) STRUCTURE, FABRICATION, AND CORRECTIVE TEST OF ELECTRON-EMITTING DEVICE HAVING ELECTRODE CONFIGURED TO REDUCE CROSS-OVER CAPACITANCE AND/OR FACILITATE SHORT-CIRCUIT REPAIR

(75) Inventors: Steven J. Radigan, Fremont, CA (US); Matthew A. Bonn, Saratoga, CA (US); Hidenori Kemmotsu, San Jose, CA (US); Theodore S. Fahlen, San Jose, CA (US)

(73) Assignees: Candescent Technologies Corporation, Los Gatos, CA (US); Candescent Intellectual Property Services, Inc., Los Gatos, CA (US); Sony Corporation, Tokyo (JP)

( * ) Notice: Subject to any disclaimer, the term of this patent is extended or adjusted under 35 U.S.C. 154(b) by 63 days.

(21) Appl. No.: 10/017,656

(22) Filed: Dec. 12, 2001

(65) Prior Publication Data

US 2003/0107311 A1 Jun. 12, 2003

(51) Int. Cl.[7] ..... H01J 1/30

(52) U.S. Cl. ..... 313/497; 313/310; 445/24

(58) Field of Search ..... 313/309, 310, 313/311, 351, 422, 495, 496, 497; 445/24, 50, 51; 315/169.1

(56) References Cited

U.S. PATENT DOCUMENTS

| | | | | |
|---|---|---|---|---|
| 5,374,868 A | | 12/1994 | Tjaden et al. | 313/310 |
| 5,459,480 A | | 10/1995 | Browning et al. | 345/75 |
| 5,569,975 A | | 10/1996 | Taylor et al. | 313/310 |
| 5,589,728 A | | 12/1996 | Levine et al. | 313/336 |
| 5,621,272 A | | 4/1997 | Levine et al. | 313/422 |
| 5,631,518 A | | 5/1997 | Barker | 313/308 |
| 5,672,933 A | | 9/1997 | Wilson et al. | 313/336 |
| 5,686,782 A | | 11/1997 | Hecker, Jr. et al. | 313/309 |
| 5,717,275 A | | 2/1998 | Takemura | 313/309 |
| 5,729,087 A | | 3/1998 | Chien | 313/495 |
| 5,754,149 A | | 5/1998 | Browning et al. | 345/75 |
| 6,002,199 A | | 12/1999 | Spindt et al. | 313/309 |
| 6,107,728 A | | 8/2000 | Spindt et al. | 313/310 |
| 6,118,279 A | | 9/2000 | Field et al. | 324/529 |
| 6,201,343 B1 | * | 3/2001 | Spindt et al. | 313/310 |
| 6,338,662 B1 | * | 1/2002 | Spindt et al. | 445/24 |
| 6,414,428 B1 | | 7/2002 | Schropp, Jr. et al. | 313/495 |

FOREIGN PATENT DOCUMENTS

| | | |
|---|---|---|
| WO | WO 98/54741 | 12/1998 |
| WO | WO 99/56299 | 11/1999 |

* cited by examiner

*Primary Examiner*—Nimeshkumar D. Patel
*Assistant Examiner*—Karabi Guharay
(74) *Attorney, Agent, or Firm*—Ronald J. Meetin

(57) ABSTRACT

An electron-emitting device (20, 70, 80, or 90) contains an electrode, either a control electrode (38) or an emitter electrode (32), having a specified portion situated off to the side of the bulk of the electrode. For a control electrode, the specified portion is an exposure portion (38EA or 38EB) having openings that expose electron-emissive elements (50A or 50B) situated over an emitter electrode. For an emitter electrode, the specified portion is an emitter-coupling portion situated below at least one electron-emissive element exposed through at least one opening in a control electrode. Configuring the device in this way enables the control-electrode-to-emitter-electrode capacitance to be quite small, thereby enhancing the device's switching speed. If the specified portion of the electrode becomes short circuited to the other electrode, the short-circuit defect can be removed by severing the specified portion from the remainder of its electrode.

72 Claims, 9 Drawing Sheets

STRUCTURE, FABRICATION, AND CORRECTIVE TEST OF ELECTRON-EMITTING DEVICE HAVING ELECTRODE CONFIGURED TO REDUCE CROSS-OVER CAPACITANCE AND/OR FACILITATE SHORT-CIRCUIT REPAIR

FIELD OF USE

This invention relates to electron-emitting devices. More particularly, this invention relates to the structure and fabrication, including repair, of an electron-emitting device suitable for use in a flat-panel display of the cathode-ray tube ("CRT") type.

BACKGROUND

A flat-panel CRT display basically consists of an electron-emitting device and a light-emitting device that operate at low internal pressure. The electron-emitting device, commonly referred to as a cathode, contains electron-emissive regions that selectively emit electrons over a relatively wide area. The emitted electrons are directed towards light-emissive regions distributed over a corresponding area in the light-emitting device. Upon being struck by the electrons, the light-emissive regions emit light that produces an image on the viewing surface of the display.

The electron-emissive regions are often situated over generally parallel emitter electrodes. In an electron-emitting device of the field-emission type, generally parallel control electrodes cross over, and are electrically insulated from, the emitter electrodes. The electron-emissive regions typically consist of electron-emissive elements exposed through openings in the control electrodes. When a suitable voltage is applied between a control electrode and an emitter electrode, the control electrode extracts electrons from the associated electron-emissive region. An anode in the light-emitting device attracts the electrons to the light-emitting device.

Short circuits sometime occur between the control electrodes, on one hand, and the emitter electrodes, on the other hand. The presence of a short circuit can have a highly detrimental effect on display performance. For example, a short circuit at the crossing between a control electrode and an emitter electrode can prevent the associated electron-emissive region from operating properly.

International Patent Publications WO 98/54741 (Spindt et al) and WO 99/56299 (also Spindt et al) describe field-emission flat-panel CRT displays in which the emitter and control electrodes of the electron-emitting devices are configured in various ways to facilitate repairing control-electrode-to-emitter-electrode short-circuit defects. While the electron-emitting devices of International Patent Publications WO 98/54741 and WO 99/56299 present various advantages, the capacitance at each location where one of the control electrodes crosses over one of the emitter electrodes can cause the devices to have unsuitably low switching speeds. It is desirable to configure the emitter or/and control electrodes in such a way that the control-electrode-to-emitter-electrode cross-over capacitance can be reduced so as to increase the switching speed while still facilitating control-electrode-to-emitter-electrode short-circuit repair.

GENERAL DISCLOSURE OF THE INVENTION

The present invention furnishes an electron-emitting device, especially one suitable for use in a flat-panel CRT display, in which a specified portion of an electrode, either a control electrode or an emitter electrode, is situated off to the side of the bulk of the electrode. In the case of the control electrode, the specified portion is an exposure portion having openings that expose electron-emissive elements situated over an emitter electrode. In the case of an emitter electrode, the specified portion is an emitter-coupling portion situated below an electron-emissive element exposed through an opening in the control electrode. By having the specified portion of the electrode situated away from the bulk of the electrode, the control-electrode-to-emitter-electrode cross-over capacitance can be made quite small. Should the specified portion of the electrode be electrically short circuited to the other electrode, the specified portion can be readily severed from the remainder of its electrode to remove the short-circuit defect.

More particularly, an electron-emitting device configured in accordance with one aspect of the invention contains an emitter electrode, an electron-emissive region, and a control electrode. The emitter electrode extends longitudinally in a first lateral direction. The electron-emissive region has an electron-emissive zone in which a multiplicity of electron-emissive elements are situated over part of the emitter electrode.

The control electrode consists at least of a rail, an intersection portion, an exposure portion, and a linkage portion. The rail crosses over the emitter electrode and extends longitudinally in a second lateral direction different from the first lateral direction. The intersection portion is continuous with the rail and extends laterally away from it. The exposure portion largely overlies the electron-emissive region and has a multiplicity of openings through which the electron-emissive elements are exposed. The linkage portion extends between, and thereby electrically connects, the intersection and exposure portions.

At least part of the linkage portion of the control electrode is normally situated lateral, i.e., to the side as viewed vertically, of the emitter electrode. The intersection portion of the control electrode is also normally situated lateral to the emitter electrode. As a result, largely only the rail and the exposure portion of the control electrode are situated above the emitter electrode. In as much as the cross-over capacitance between a control electrode and an emitter electrode depends (in part) on the amount of area where the control electrode overlies the emitter electrode, configuring the control electrode in the foregoing way enables the present electron-emitting device to have a very low control-electrode-to-emitter-electrode cross-over capacitance. Accordingly, the switching speed of the electron-emitting device is enhanced, and its power consumption is reduced.

In the course of manufacturing an electron-emitting device configured according to the invention's teaching, the device can be examined to determine whether the control electrode appears to be short circuited to the emitter electrode at the exposure portion. If so, a cut is made through the linkage portion to electrically separate the exposure portion from the remainder of the control electrode, specifically from the rail and intersection portion. Although the cut causes the exposure portion to become inoperative (disabled), an electron-emitting device having many such exposure portions can often perform adequately when a small number of the exposure portions are inoperative. In such a case, removal of the short-circuited exposure portion repairs the device.

The short-circuit repair operation at the exposure portion of the control electrode is normally done by directing light on the linkage portion of the control electrode. With at least part of the linkage portion being situated lateral to the emitter electrode, the light is typically directed on a part of the exposure portion not vertically in line with the emitter electrode. This enables the short-circuit defect to be removed without significantly affecting the emitter electrode. The configuration of the control electrode thereby facilitates repairing a short-circuit defect between the emitter electrode and the control electrode's exposure portion.

In one variation of the present electron-emitting device, the control electrode includes a further rail extending longitudinally in the second lateral direction and thus generally parallel to the first-mentioned rail. The intersection portion of the control electrode is continuous with, and extends laterally away from, the further rail so as to be at least partially located between the two rails. The exposure portion is normally situated between the rails.

Use of two rails provides redundancy that enables certain defects involving the rails to be overcome. For instance, if a segment of one of the rails becomes short circuited to the emitter electrode, the short-circuited segment of that rail can be severed from the remainder of the rail and thus from the remainder of the control electrode. Current that would otherwise flow through the short-circuited rail segment is shunted to the other rail and, after passing the short-circuit location, returns (at least partially) to the rail from which the short-circuited segment has been removed. The electron-emitting device can operate in the normal manner even though part of one of the rails is short circuited to the emitter electrode.

In another variation of the present electron-emitting device, the control electrode includes a further linkage portion extending between the exposure portion and a further intersection portion continuous with the rail. Should the first-mentioned linkage portion be defective, the further intersection and linkage portions can provide a current path from the rail to the exposure portion to overcome the defect in the first-mentioned linkage portion. The electron-emitting device of the invention can operate normally even though one of the linkage portions is defective. Should the exposure portion be short circuited to the emitter electrode, cuts can be made through both linkage portions to electrically separate the exposure portion from the remainder of the control electrode.

The electron-emissive region, which is normally one of a group of laterally separated electron-emissive regions each situated opposite a corresponding light-emissive region, may include an additional electron-emissive zone containing a multiplicity of additional electron-emissive elements situated over (another) part of the emitter electrode. In that case, the control electrode includes an additional exposure portion and an additional linkage portion. The additional exposure portion largely overlies the additional electron-emissive zone and has a multiplicity of additional openings through which the additional electron-emissive elements are exposed. The additional linkage portion extends between the intersection portion and the additional exposure portion. By implementing the electron-emissive region with two separate electron-emissive zones, electrons emitted by the electron-emissive region can be better directed toward the oppositely situated light-emissive region.

The lateral configurational features applied to the control electrode for reducing the control-electrode-to-emitter-electrode cross-over capacitance and/or facilitating control-electrode-to-emitter-electrode short-circuit repair are transferred to the emitter electrode in an electron-emitting device configured according to another aspect of the invention. In particular, the emitter electrode in this aspect of the invention consists at least of a rail, an intersection portion, an emitter-coupling portion, and a linkage portion. The emitter-coupling portion replaces the control electrode's exposure portion in the earlier-mentioned aspect of the invention. The electron-emitting device in this aspect of the invention contains an electron-emissive region having an electron-emissive zone that overlies the emitter-coupling portion. Although typically containing multiple electron-emissive elements in this aspect of the invention, the electron-emissive zone may have as little as one electron-emissive element.

Analogous to the linkage portion of the control electrode in the earlier-mentioned aspect of the invention, the linkage portion of the emitter electrode extends from the intersection portion to the emitter-coupling portion. Subject to the emitter-coupling portion replacing the exposure portion, all of the above-described variations of the control electrode can be applied to the emitter electrode. Configuring the emitter electrode according to this aspect of the invention enables the control-electrode-to-emitter-electrode cross-over capacitance to be reduced and control-electrode-to-emitter-electrode short-circuit repair to be facilitated in the way described above.

In short, an electron-emitting device configured according to the invention has reduced capacitance at locations where a control electrode crosses over an emitter electrode, thereby improving the device's switching speed and reducing the device's power consumption. The control or emitter electrode is configured to facilitate repairing short-circuit defects between the emitter and control electrodes. This typically includes shunting current around certain types of short-circuit defects. Defects in the rails and/or linkage portions can be overcome by furnishing the present electron-emitting devices with extra rails and/or extra linkage portions. Accordingly, the invention provides a substantial advance.

BRIEF DESCRIPTION OF THE DRAWINGS

FIG. 3 is also a cross-sectional side view of part of the active region of the flat-panel CRT display of FIG. 6. The plan view of FIG. 5 presents the layout of the electron-emitting device as seen along plane 5—5 in FIGS. 3 and 6.

Figure 3:
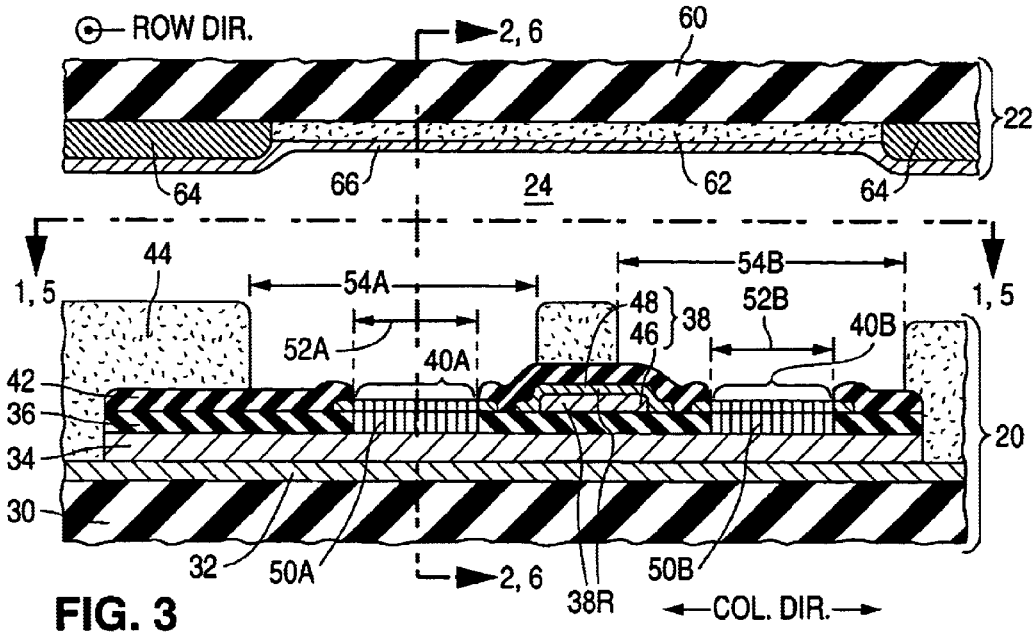
Figure 5:
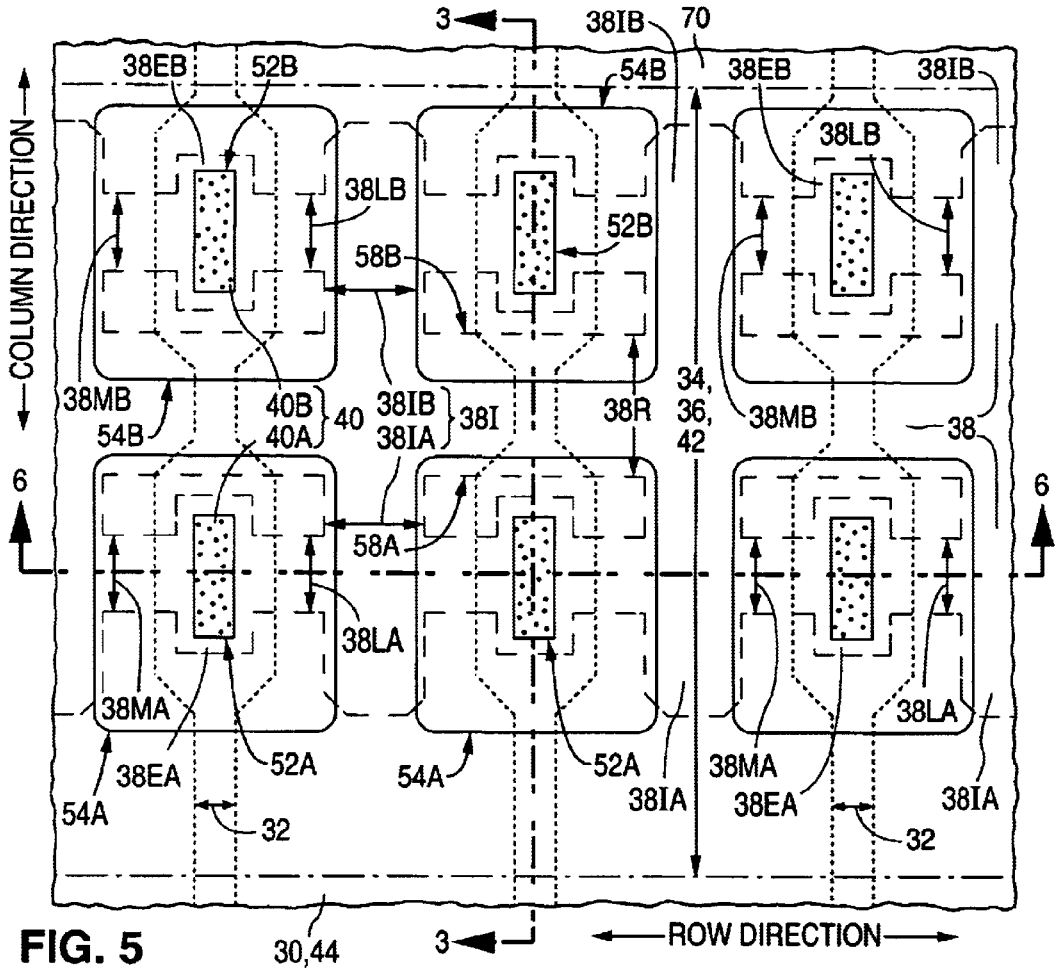
FIG. 5 is a plan view of part of the active portion of another electron-emitting device configured according to the invention to reduce control-electrode-to-emitter-electrode cross-over capacitance and to facilitate control-electrode-to-emitter-electrode short-circuit repair.
Figure 6:
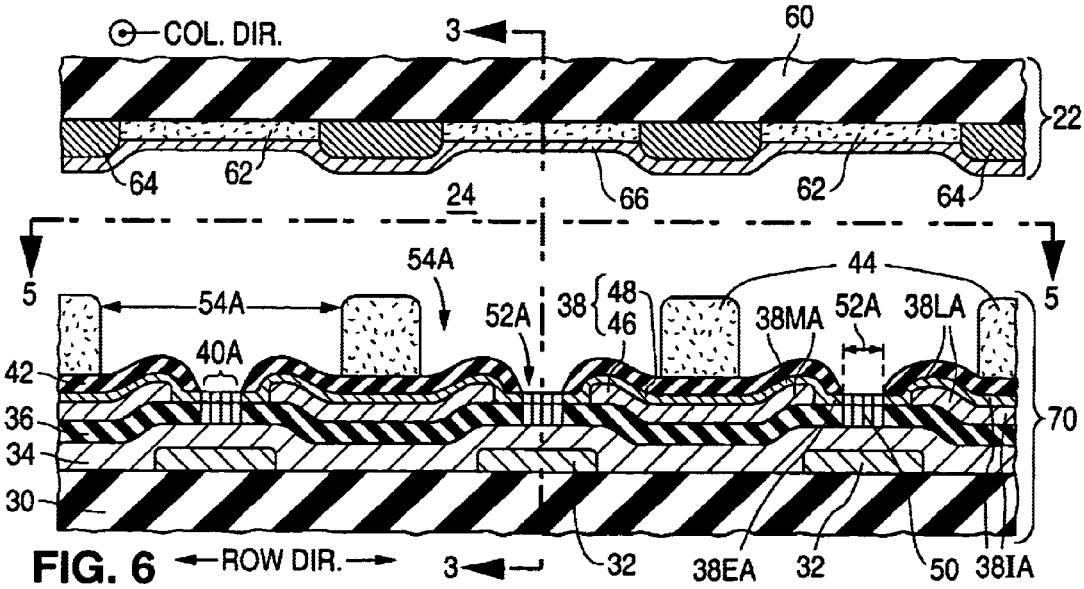
FIG. 6 is a cross-sectional side view of part of the active region of a flat-panel CRT display configured according to the invention to incorporate the electron-emitting device of FIG. 5.

The cross section of FIG. 6 is taken along plane 6—6 in FIGS. 3 and 5. The cross section of FIG. 3 is taken along plane 3—3 in FIGS. 5 and 6.

Figure 7:
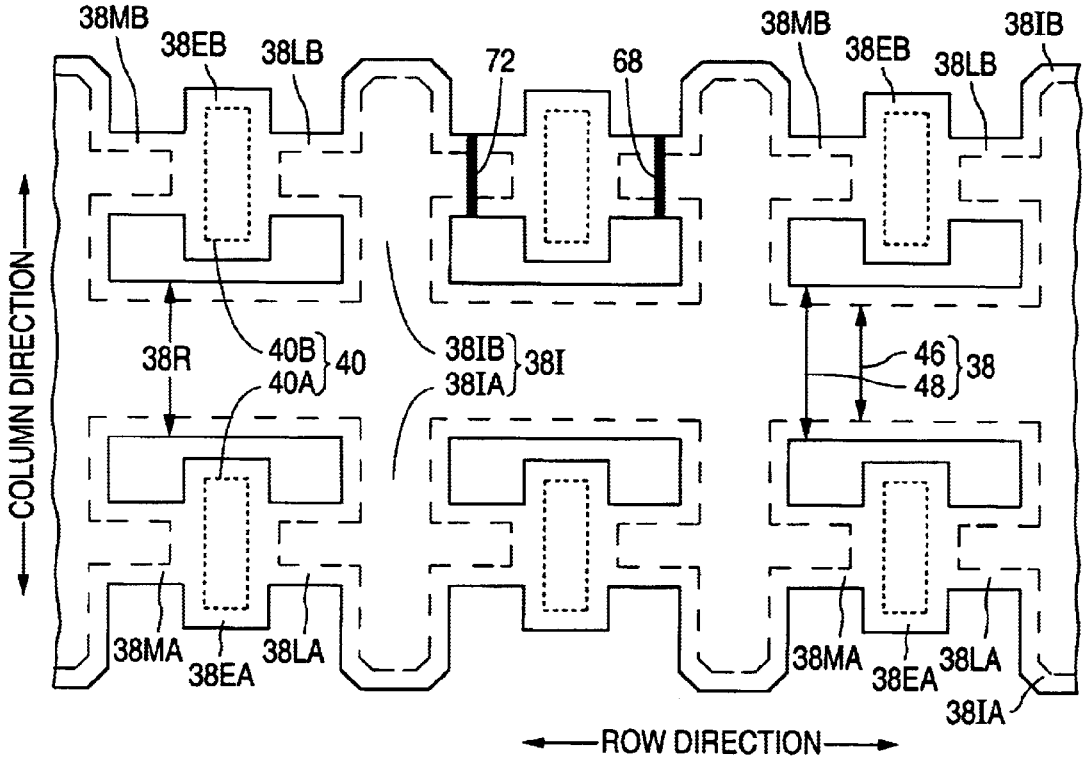

FIG. 7 is a plan view of part of one control electrode in the electron-emitting device of FIGS. 3, 5, and 6.

Figure 8:
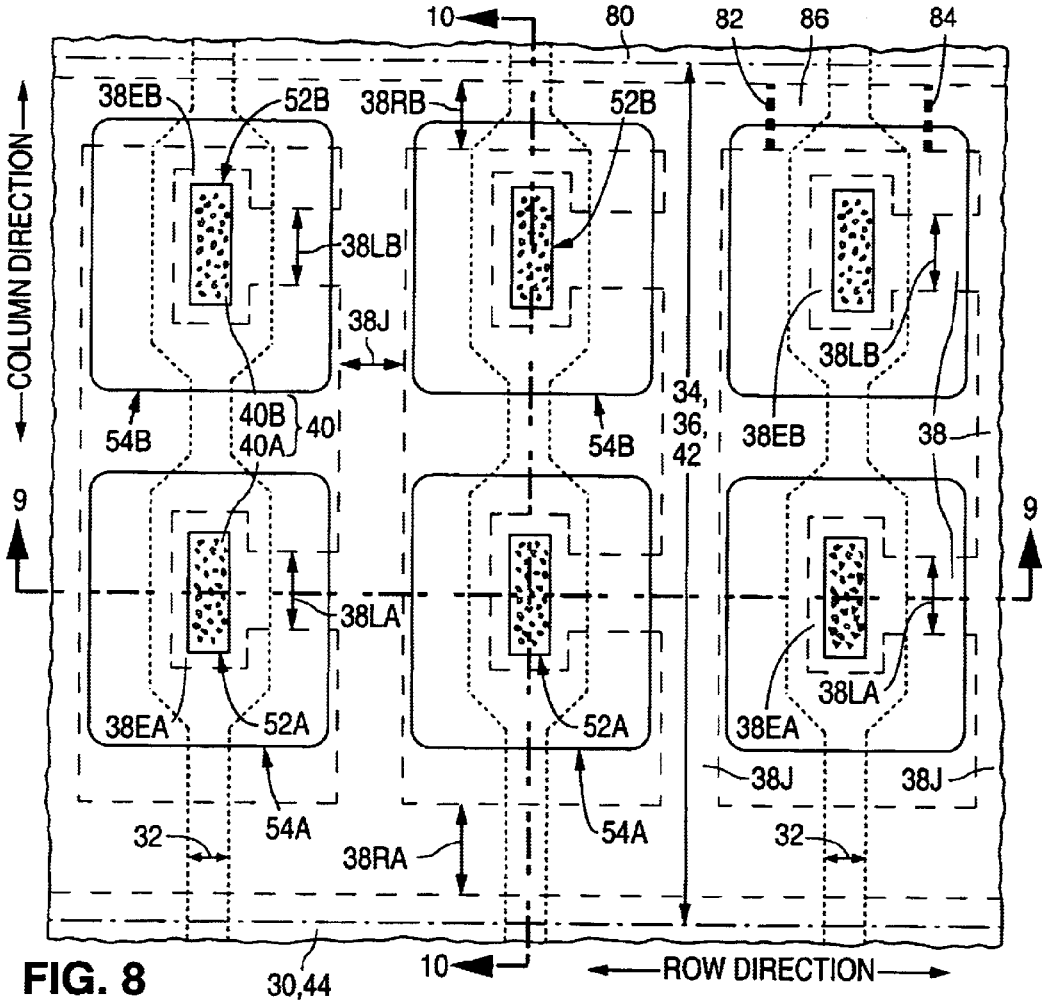

FIG. 8 is a plan view of part of the active portion of a further electron-emitting device configured according to the invention to reduce control-electrode-to-emitter-electrode cross-over capacitance and to facilitate control-electrode-to-emitter-electrode short-circuit repair.

Figure 9:
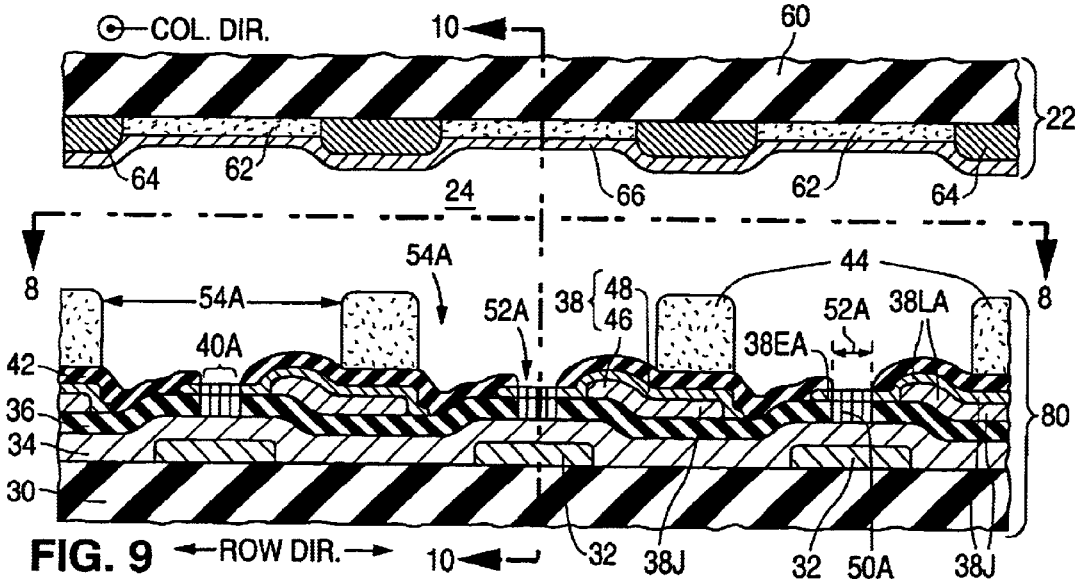
Figure 10:
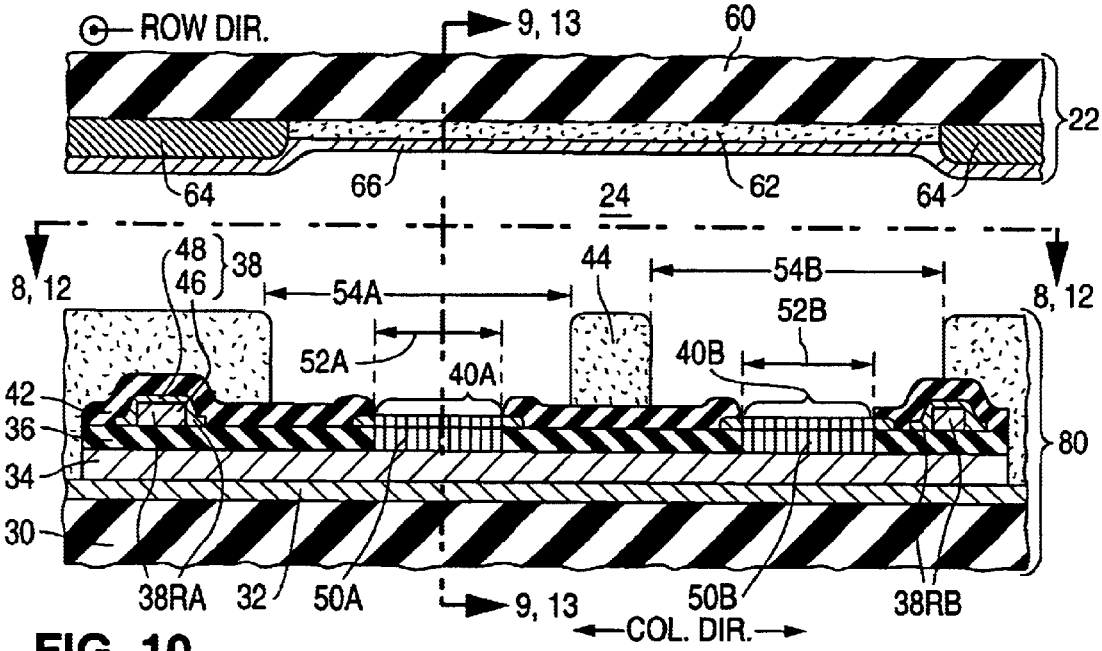

FIGS. 9 and 10 are cross-sectional views of part of the active region of a flat-panel CRT display configured according to the invention to incorporate the electron-emitting device of FIG. 8. The plan view of FIG. 8 presents the layout of the electron-emitting device as seen along plane 8—8 in FIGS. 9 and 10. The cross section of FIG. 9 is taken along plane 9—9 in FIGS. 8 and 10. The cross section of FIG. 10 is taken along plane 10—10 in FIGS. 8 and 9.

Figure 11:
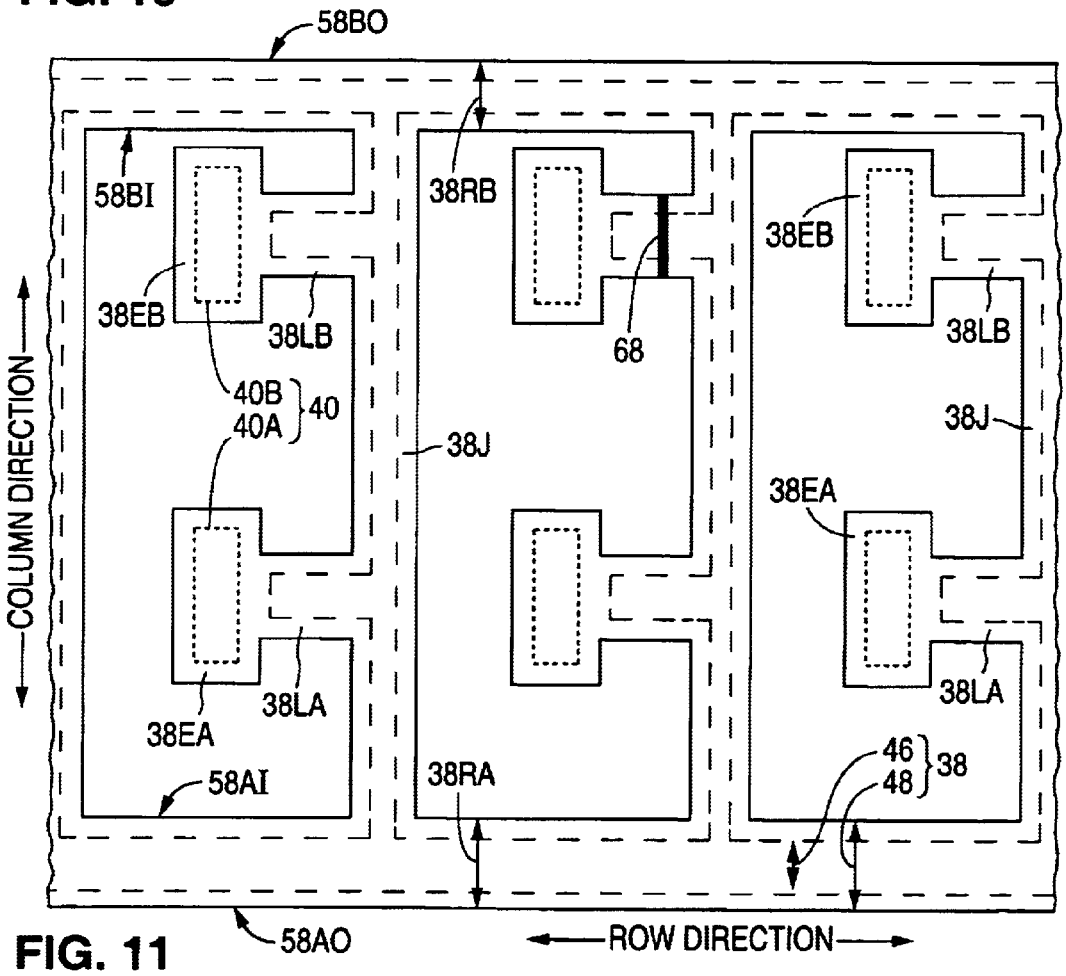

FIG. 11 is a plan view of part of one control electrode in the electron-emitting device of FIGS. 8–10.

Figure 12:
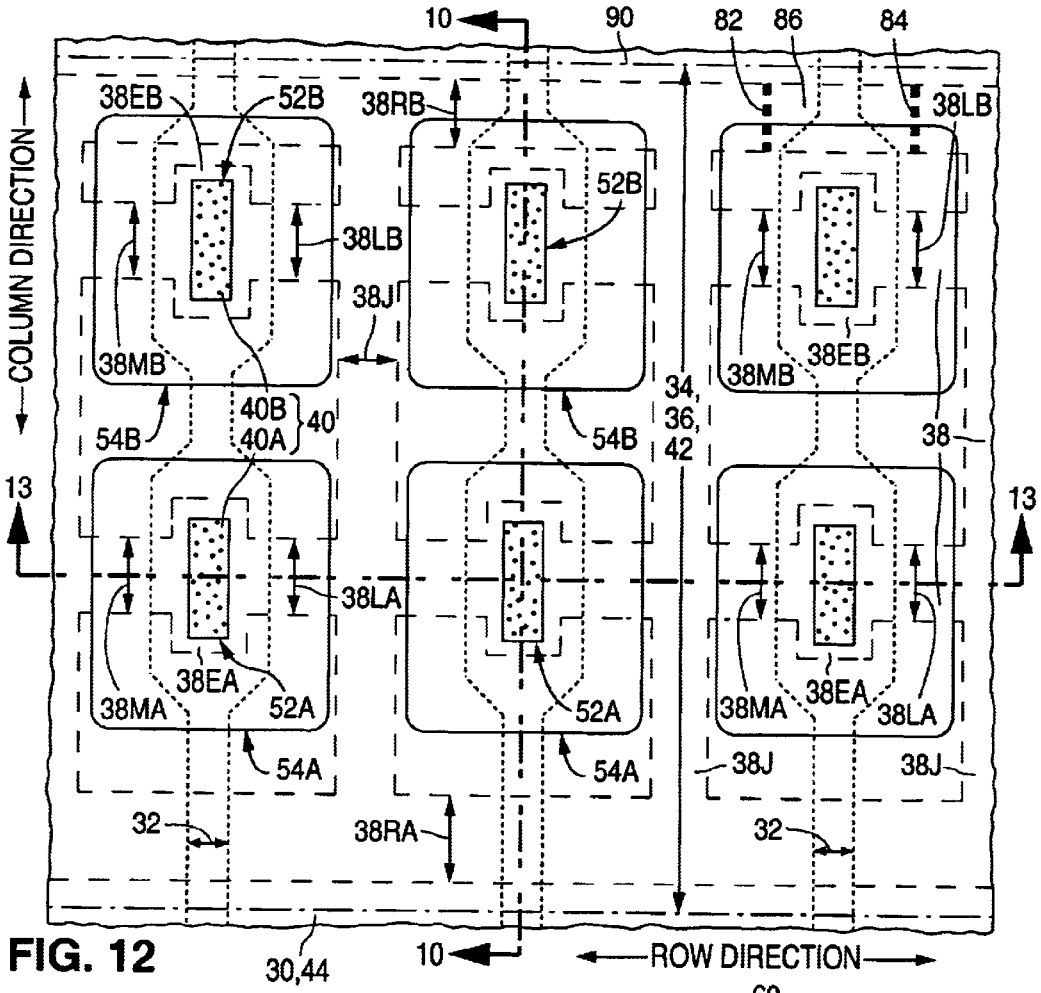

FIG. 12 is a plan view of part of the active portion of yet another electron-emitting device configured according to the invention to reduce control-electrode-to-emitter-electrode cross-over capacitance and to facilitate control-electrode-to-emitter-electrode short-circuit repair.

Figure 13:
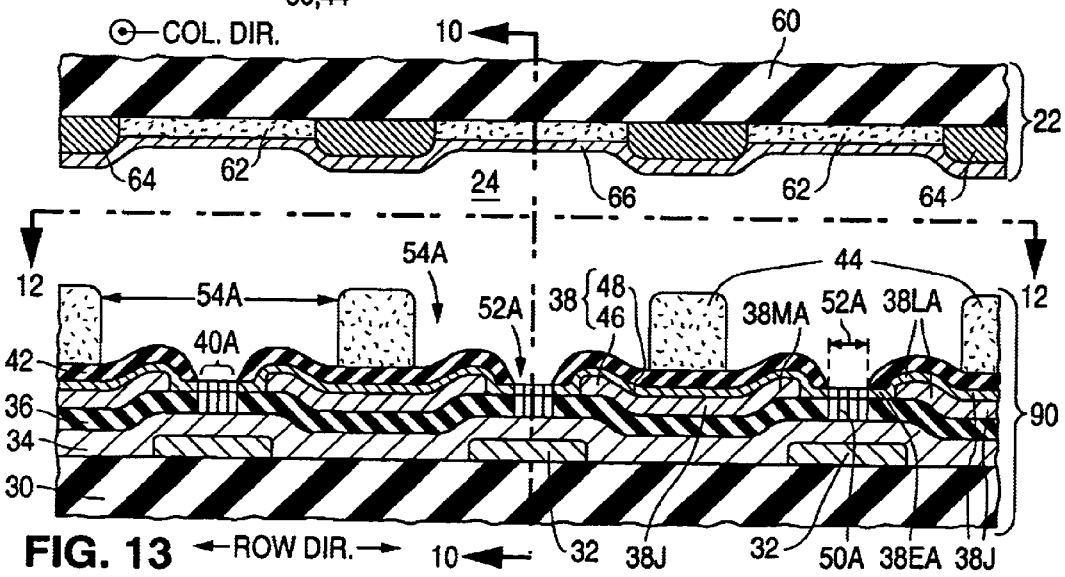

FIG. 13 is a cross-sectional side view of part of the active region of a flat-panel CRT display configured according to the invention to incorporate the electron-emitting device of FIG. 12. FIG. 10 is also a cross-sectional side view of part of the active region of the flat-panel CRT display of FIG. 13. The plan view of FIG. 12 presents the layout of the electron-emitting device as seen along plane 12—12 in FIGS. 10 and 13. The cross section of FIG. 13 is taken along plane 13—13 in FIGS. 10 and 12. The cross section of FIG. 10 is taken along plane 10—10 in FIGS. 12 and 13.

Figure 14:
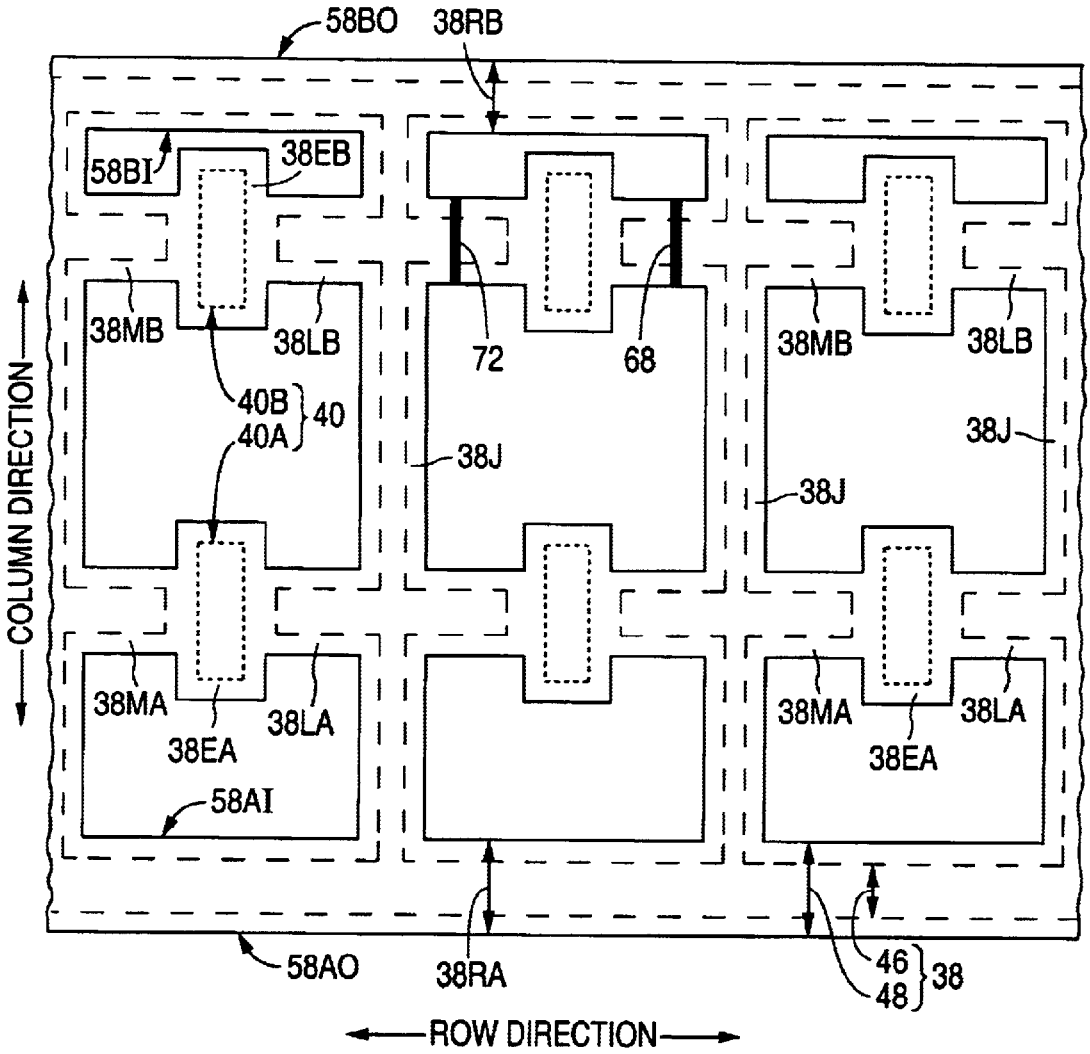

FIG. 14 is a plan view of one control electrode in the electron-emitting device of FIGS. 10, 12, and 13.

Figure 15:
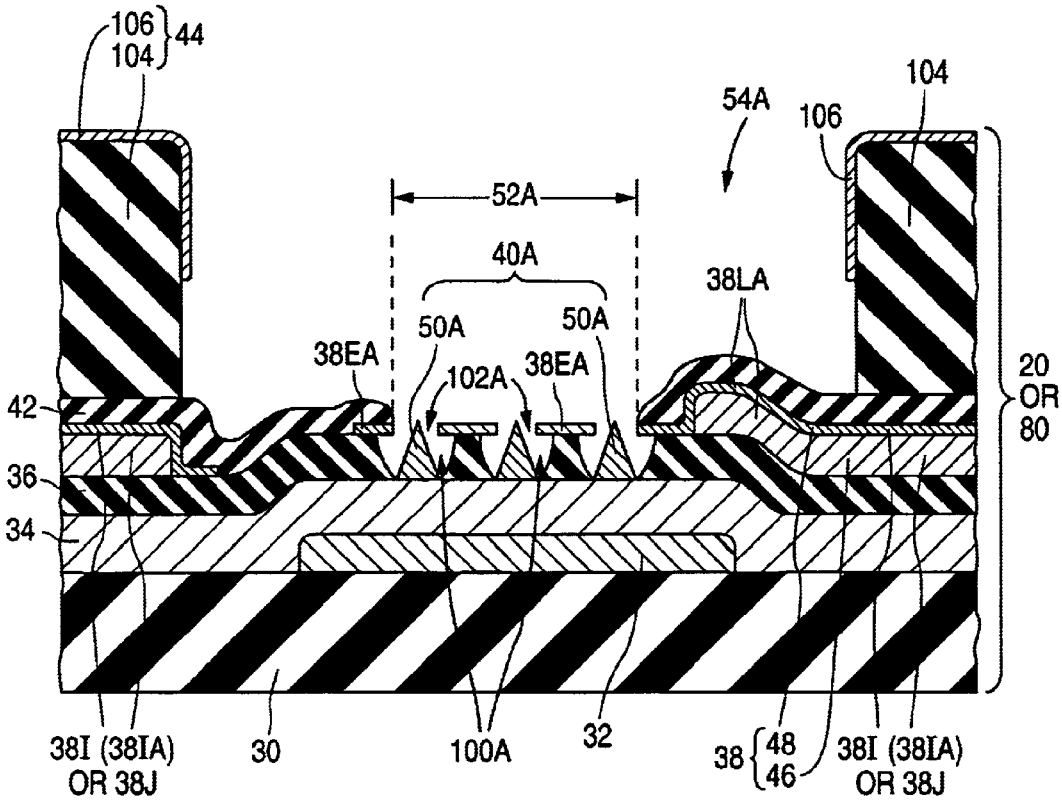

FIG. 15 is a magnified cross-sectional side view centering around an electron-emissive zone of one of the electron-emissive regions of FIGS. 1–4 or FIGS. 8–11.

In the plan views of the present electron-emitting devices having control electrodes configured to facilitate control-electrode-to-emitter-electrode short-circuit repair, the control electrodes are depicted in dashed lines while emitter electrodes are depicted in dotted lines. In the plan views of the control electrodes, the main control portions of the control electrodes are indicated in dashed lines. The positions of electron-emissive regions are indicated by dotted lines in the control-electrode plan views.

Like reference symbols are employed in the drawings and in the description of the preferred embodiments to represent the same, or very similar, item or items.

DESCRIPTION OF THE PREFERRED EMBODIMENTS

General Considerations

Various structures are described below for flat-panel CRT displays having electron-emitting devices configured in accordance with the invention to reduce the cross-over capacitance between control and emitter electrodes. The electron-emitting device in each of the present flat-panel displays is also configured according to the invention to facilitate removal (repair) of short-circuit defects between the control and emitter electrodes. Each of the present flat-panel CRT displays, typically of the field-emission type, is generally suitable for a flat-panel television or a flat-panel video monitor for a personal computer, a laptop computer, a workstation, or a hand-held device such as a personal digital assistant.

Each of the present flat-panel displays is typically a color display but can be a monochrome, e.g., black-and-green or black-and-white, display. Each light-emissive region and the corresponding oppositely situated electron-emissive region form a pixel in a monochrome display, and a sub-pixel in a color display. A color pixel typically consists of three sub-pixels, one for red light, another for green light, and the third for blue light. Each pixel, whether color or monochrome, provides a dot of the image produced by the display. A subpixel in a color display thus provides part of a dot of the display's image.

The control electrodes in each of the present electron-emitting devices control the magnitudes of the electron currents travelling to the oppositely situated light-emitting device. When the electron-emitting device operates according to field (cold) emission, the control electrodes extract electrons from the electron-emissive elements. An anode in the light-emitting device attracts the extracted electrons to the light-emissive regions.

When the electron-emitting device contains electron-emissive elements which continuously emit electrons during display operation, e.g., by thermal emission, the control electrodes selectively pass the emitted electrons. That is, electrons are emitted under conditions which, in the absence of the control electrodes, would enable those electrons to go past the locations of the control electrodes. The control electrodes permit certain of those electrons to pass, and collect the remaining electrons or otherwise prevent the remainder from passing. The anode in the light-emitting device attracts the passed electrons to the light-emissive regions.

In the following description, the term "electrically insulating" or "dielectric" generally applies to materials having a resistivity greater than $10^{10}$ ohm-cm at 25° C. The term "electrically non-insulating" thus refers to materials having a resistivity of no more than $10^{10}$ ohm-cm at 25° C. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm at 25° C. These categories are determined at an electric field of no more than 10 volts/$\mu$m.

Figure 1:
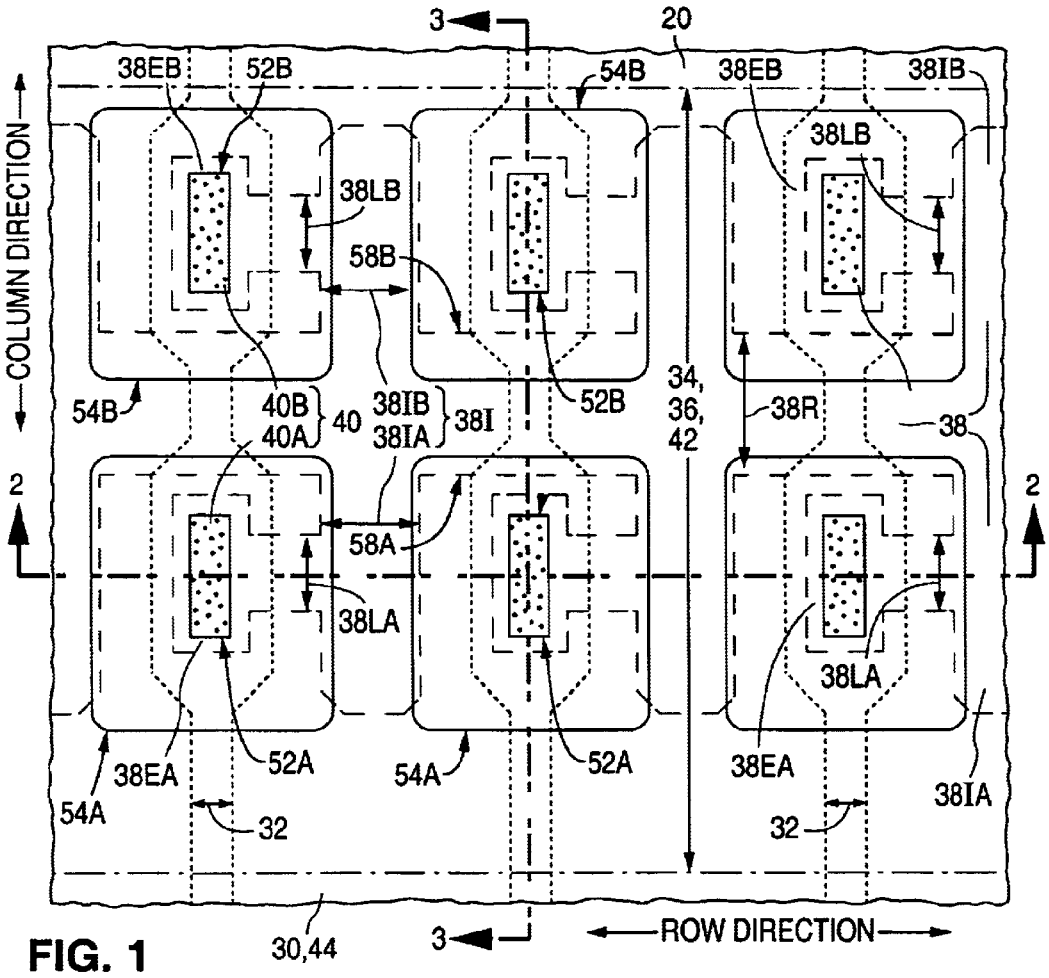
FIG. 1 is a plan view of part of the active portion of an electron-emitting device configured according to the invention to reduce control-electrode-to-emitter-electrode cross-over capacitance and to facilitate control-electrode-to-emitter-electrode short-circuit repair.
Figure 2:
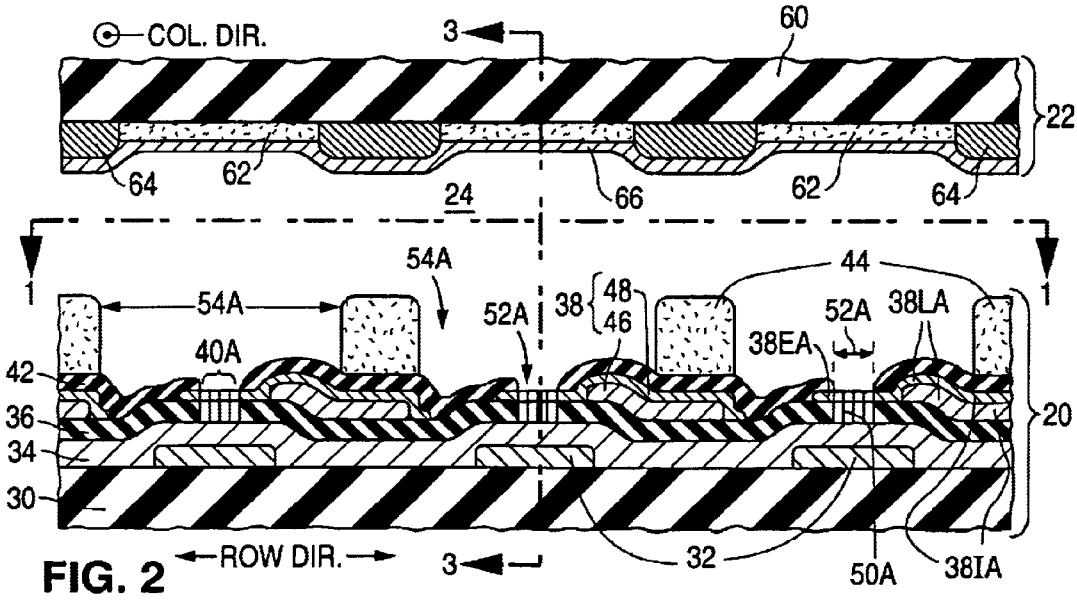
FIGS. 2 and 3 are cross-sectional side views of part of the active region of a flat-panel CRT display configured according to the invention to incorporate the electron-emitting device of FIG. 1. The plan view of FIG. 1 presents the layout of the electron-emitting device as seen along ad plane 1—1 in FIGS. 2 and 3. The cross section of FIG. 2 is taken along plane 2—2 in FIGS. 1 and 3. The cross section of FIG. 3 is taken along plane 3—3 in FIGS. 1 and 2.

Electron-emitting Device with Single-Rail Control Electrodes Having Cuttable Links FIG. 1 illustrates a plan view of part of the active portion of an electron-emitting device 20 designed in accordance with the invention to reduce control-electrode-to-emitter-electrode cross-over capacitance and to facilitate control-electrode-to-emitter-electrode short-circuit repair. FIGS. 2 and 3 present cross sections of part of the active region of a flat-panel CRT display designed in accordance with the invention to employ electron-emitting device 20 and an oppositely situated light-emitting device 22. The cross sections of FIGS. 2 and 3 are taken perpendicular to each other.

Electron-emitting device 20 and light-emitting device 22 are connected together through an outer wall (not shown) to form a sealed enclosure 24 maintained at a high vacuum, typically an internal pressure of no more than $10^{-6}$ torr. A spacer system (also not shown) is situated between devices 20 and 22 inside enclosure 24 for resisting external forces exerted on the flat-panel display and for maintaining a relatively uniform spacing between devices 20 and 22. In particular, the spacer system prevents the external-to-internal pressure differential of approximately 1 atm. from collapsing the display.

Electron-emitting device, or backplate structure, 20 is formed with a transparent generally flat electrically insulating backplate 30, a group of opaque laterally separated generally parallel emitter electrodes 32, an electrically resistive layer 34, a transparent inter-electrode dielectric layer 36, a group of laterally separated generally parallel control electrodes 38, a two dimension array of rows and columns of laterally separated largely identical electron-emissive regions 40, a transparent electrically insulating passivation layer 42, and an electron-focusing system 44. Emitter electrodes 32 are situated on backplate 30 and extend longitudinally generally parallel to the columns of electron-emissive regions 40 in a lateral direction referred as the column direction. In FIG. 1, the column direction extends vertically parallel to the plane of the figure. The column direction extends into the plane of FIG. 2. Since FIGS. 2 and 3 are at perpendicular cross sections, the column direction extends horizontally parallel to the plane of FIG. 3.

Resistive layer 34 lies on emitter electrodes 32 and extends down to backplate 30 in the spaces between electrodes 32. In FIGS. 1 and 3, resistive layer 34 is illustrated as a patterned layer. Layer 34 can be a blanket (unpatterned) layer or can be patterned differently from what is indicated in FIGS. 1 and 3. In any event, layer 34 normally fully overlies each electrode 32. Although not fully transparent, layer 34 transmits a substantial percentage, typically 40–95%, of incident light.

Inter-electrode dielectric layer 36 lies on resistive layer 34. In some embodiments of electron-emitting device 20 where resistive layer 34 is patterned, dielectric layer 36 can extend down to backplate 30 or/and emitter electrodes 32 at locations where resistive layer 34 is absent.

Figure 4:
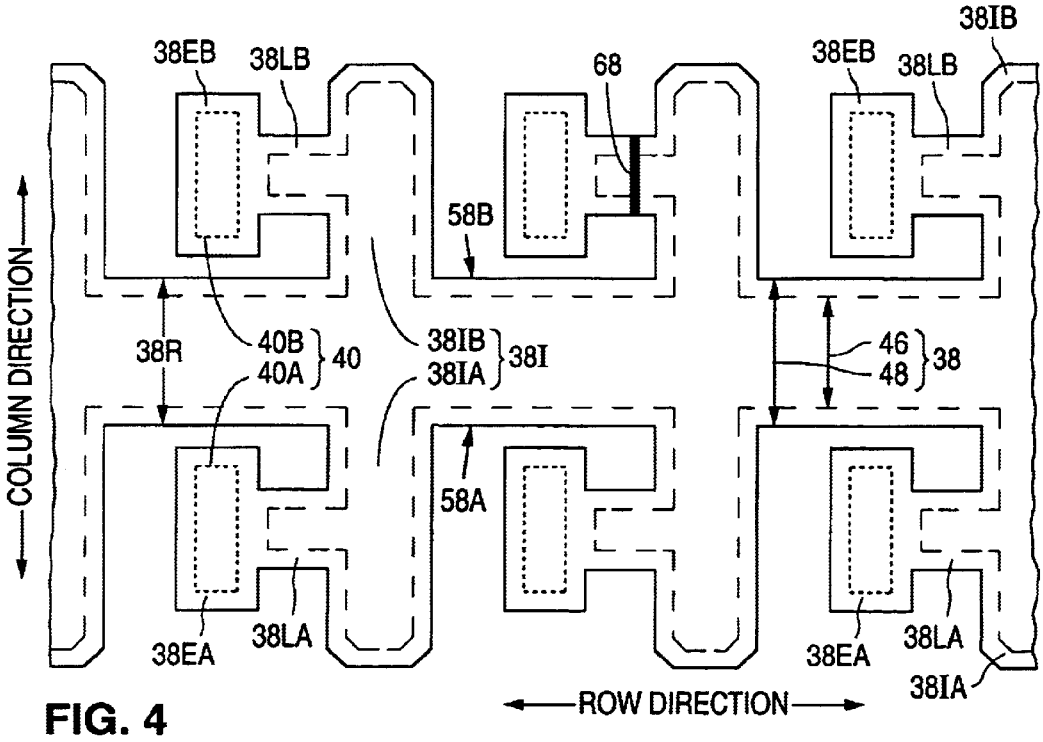
FIG. 4 is a plan view of part of one control electrode in the electron-emitting device of FIGS. 1–3.

Control electrodes 38 are situated on dielectric layer 36 and extend longitudinally generally parallel to the rows of electron-emissive regions 40 in a direction referred to as the row direction. The row and column directions are largely perpendicular to each other. In FIGS. 1 and 2, the row direction extends horizontally parallel to the planes of the two figures. The row direction extends into the plane of FIG. 3. Only one of control electrodes 38 is depicted in FIGS. 1–3. FIG. 4 illustrates the layout of one electrode 38 in electron-emitting device 20 as seen from enclosure 24.

Each control electrode 38 consists of a main control portion 46 and one or more thinner gate portions 48 that vertically adjoin main control portion 46. FIGS. 1–4 present an example in which each electrode 38 contains only one gate portion 48. At locations where gate portions 48 adjoin main control portions 46, gate portions 48 may extend above or below main portions 46. Gate portions 48 extend over main control portions 46 in the example of FIGS. 1–4.

Gate portions 48 extend laterally beyond main control portions 46 at the locations for electron-emissive regions 40 and may extend laterally beyond main portions 46 at other locations. Main portions 46 may also extend laterally beyond gate portions 48 at certain locations. In the example of FIGS. 1–4, each gate portion 48 extends laterally beyond the entire lateral periphery of associated main portion 46. Since gate portions 48 extend over main portions 46 in this example, gate portions 48 fully cover main portions 46 in the example of FIGS. 1–4. In FIG. 4, the lateral periphery of illustrated gate portion 48, and thus also illustrated control electrode 38, is indicated by solid line while the lateral periphery of illustrated main portion 46 is indicated by dashed line.

Each electron-emissive region 40 consists of a pair of laterally separated largely identical electron-emissive zones 40A and 40B in the example of FIGS. 1–4. The lateral peripheries of electron-emissive zones 40A and 40B are indicated by dotted lines in FIG. 4. Both of zones 40A and 40B in each electron-emissive region 40 are situated generally opposite a corresponding light-emitting region in light-emitting device 22. Electrons emitted by zones 40A and 40B of each region 40 are thereby intended to strike the corresponding light-emissive region and cause it to produce suitable light. With electron-focusing system 44 (described further below) being suitably configured, the implementation of each region 40 as a pair of zones 40A and 40B enables electrons emitted by that region 40 to be better directed (focused) toward the oppositely situated light-emissive region.

Each electron-emissive zone 40A or 40B consists of multiple electron-emissive elements 50A or 50B situated largely in openings (not explicitly shown here) extending through dielectric layer 36. The number of electron-emissive elements 50A or 50B per zone 40A or 40B is normally quite high, e.g., 500–20,000, typically 5,000. Elements 50A and 50B of zones 40A and 40B of each region 40 lie on resistive layer 34 above an associated one of emitter electrodes 32. Layer 34 limits the current that flows through each element 50A or 50B. Elements 50A or 50B of each zone 40A or 40B are normally situated at locations substantially random relative to one another.

Electron-emissive elements 50A and 50B of zones 40A and 40B of each electron-emissive region 40 are exposed through openings (not shown) extending through gate portion 48 of an associated one of control electrodes 38. The locations of elements 50A and 50B and the associated openings through electrodes 38 are indicated by dots in FIG. 1. Although the lateral peripheries of electron-emissive zones 40A and 40B are shown (by dotted lines) in FIG. 4, the openings through electrodes 38 are not indicated in FIG. 4. Each element 50A or 50B typically consists of a cone or a filament. A more detailed cross section centering around zone 40A of one region 40 is presented below in FIG. 15.

Insulating passivation layer 42 lies on control electrodes 38 and extends substantially beyond electrodes 38 down to dielectric layer 36 in the spaces between electrodes 38. Since gate portions 48 of electrodes 38 fully cover main portions 46 in the example of FIGS. 1–4, passivation layer 42 lies specifically on top of gate portions 48 in this example. A two-dimension array of rows and columns of pairs of exposure openings 52A and 52B respectively corresponding to electron-emissive zones 40A and 40B extend through passivation layer 42 at the locations for zones 40A and 40B. With electron-emissive elements 50A and 50B of zones 40A and 40B of each region 40 being exposed through openings (again not explicitly shown here) in gate portions 48, electron-emissive elements 50A or 50B of zone 40A or 40B are exposed to enclosure 24 through associated exposure opening 52A or 52B.

A two-dimensional array of rows and columns of pairs of main control openings respectively corresponding to exposure openings 52A and 52B extend through main control portions 46 of control electrodes 38 roughly at the locations for electron-emissive zones 40A and 40B. Each main control opening is laterally wider than, and fully laterally surrounds, corresponding exposure opening 52A or 52B. Accordingly, each exposure opening 52A or 52B defines the lateral extent (dimensions) of corresponding zone 40A or 40B. Alternatively, electron-emitting device 20 can be configured so that the lateral extents of zones 40A and 40B are defined by the main control openings. Passivation layer 42 may, or may not, be present in this alternative. If present, layer 42A does not extend significantly laterally beyond control electrodes 38.

Electron-focusing system 44 is situated on passivation layer 42 in the example of FIGS. 1–4. FIGS. 2 and 3 show that system 44 extends partially above control electrodes 38. In the absence of passivation layer 42, system 44 lies on electrodes 38 and extends down to dielectric layer 36 in the spaces between electrodes 38. If passivation layer 42 is present but does not define the lateral extents of electron-emissive zones 40A and 40B, system 44 can variously lie on passivation layer 42, electrodes 38, and dielectric layer 36.

A two-dimensionsal array of rows and columns of pairs of focus openings 54A and 54B respectively corresponding to electron-emissive zones 40A and 40B extend through electron-focusing system 44 roughly at the locations for zones 40A and 40B. Each focus opening 54A or 54B is laterally wider than corresponding zone 40A or 40B. Referring to FIG. 1, each opening 54A or 54B fully laterally surrounds corresponding zone 40A or 40B as viewed perpendicular (to either surface of) backplate 30. Electrons emitted by electron-emissive elements 50A or 50B of each zone 40A or 40B pass through the corresponding main control opening in associated control electrode 38, pass through corresponding exposure opening 52A or 52B when passivation layer 42 is present, and then pass through corresponding focus opening 54A or 54B along trajectories directed toward light-emitting device 22.

A suitable focus potential is applied to electron-focusing system 44 from an appropriate voltage source (not shown). An example of the internal configuration of system 44 is presented below in FIG. 15. In any event, system 44 is normally configured so that material carrying the focus potential extends from the tops of focus openings 54A and 54B at least partway down into each of them. Material carrying the focus potential also typically extends along the top of system 44.

Electron-focusing system 44 focuses electrons emitted by electron-emissive elements 50A and 50B of zones 40A and 40B of each electron-emissive region 40 on the corresponding light-emissive region in light-emitting device 22. The electron focusing is controlled by the focus potential and by suitably positioning electron-emissive zone 40A or 40B laterally relative to corresponding focus opening 54A or 54B. Implementing each electron-emissive region 40 as zones 40A and 40B provides further control on the electron focusing so that the emitted electrons impinge on the oppositely situated light-emissive region in a desired manner. Further information on this type of focus control is presented in Dunphy, U.S. patent application Ser. No. 09/967,728, filed Sep. 28, 2001, the contents of which are incorporated by reference herein. The layout of openings 54A and 54B relative to zones 40A and 40B in electron-emitting device 20 is an implementation of one of the layout designs in Dunphy.

Backplate 30 typically consists of glass. Emitter electrodes 32 are formed with metal such as aluminum, vanadium, nickel, niobium, molybdenum, tantalum, and/or tungsten. Electrodes 32 have an average thickness of 0.2–0.5 $\mu$m, typically 0.35 $\mu$m, when they consist of tungsten. Resistive layer 34 is implemented with one or more layers consisting of various materials such as cermet (ceramic with embedded metal particles), silicon carbide, and amorphous silicon. The average thickness of layer 34 is 0.1–0.5 $\mu$m, typically 0.3 $\mu$m. Dielectric layer 36 consists of material such as silicon oxide. The average thickness of layer 36 is 0.1–1.0 $\mu$m, typically 0.15–0.2 $\mu$m.

Main control portions 46 of control electrodes 38 are formed with metal such as aluminum, vanadium nickel, niobium, molybdenum, tantalum, and/or tungsten. Main control portions 46 have an average thickness of 0.2–0.5 $\mu$m, typically 0.35 $\mu$m, when they consist of tungsten. Gate portions 48 are formed with metal such as chromium or nickel. The average thickness of gate portions 48 is 10–80 nm, typically 30–50 nm, when they consist of chromium. Electron-emissive elements 50A and 50B typically consist of metal such as molybdenum. Passivation layer 42, when present, consists of material such as silicon nitride or silicon oxide. The average thickness of layer 42 is 0.1–0.5 $\mu$m, typically 0.2 $\mu$m.

Returning to control electrodes 38, each electrode 38 is arranged laterally to consist of a rail 38R, a group of laterally separated largely identical intersection portions 38I respectively corresponding to emitter electrodes 32, a group of laterally separated largely identical first linkage portions 38LA respectively corresponding to emitter electrodes 32 and thus respectively corresponding to intersection portions 38I here, a group of laterally separated largely identical second linkage portions 38LB respectively corresponding to electrodes 32, a group of laterally separated largely identical first exposure portions 38EA respectively corresponding to electrodes 32, and a group of laterally separated largely identical second exposure portions 38EB respectively corresponding to electrodes 32. Especially see FIG. 4.

Rail 38R of each control electrode 38 extends longitudinally generally in the row direction. More particularly, each rail 38 has a pair of opposite outer longitudinal sides 58A and 58B extending generally parallel to each other in the row direction. Rails 38R extend fully across the active portion of electron-emitting device 20. Accordingly, each rail 38R crosses over all of emitter electrodes 32.

Rail 38R of each control electrode 38 consists of part of that electrode's main control portion 46 and, in the example of FIGS. 1 and 4, part of that electrode's gate portion 48. The main control (46) part of each rail 38R extends substantially its entire length (in the row direction) and thus fully across the active portion of electron-emitting device 20. Although FIGS. 1–4 illustrate rail 38R of each electrode 38 as including part of that electrode's gate portion 48, each rail 38R may consist solely of part of that electrode's main portion 46.

Intersection portions 381 of each control electrode 38 intersect with, and extend laterally away from, that electrode's rail 38R. Each portion 38I consists of a pair of intersection segments 38IA and 38IB. Intersection segment 38IA of each electrode 38 is continuous with outer longitudinal side 58A of that electrode's rail 38R and thereby extends laterally away from that side 58A. Similarly, intersection segment 38IB of each electrode 38 is continuous with outer longitudinal side 58B of that electrode's rail 38R and thereby extends laterally away from that side 58B. Since intersection segments 38IA and 38IB of each electrode 38 are on opposite sides of that electrode's rail 38R, intersection portions 38I of each electrode 38 effectively cross that electrode's rail 38R.

As shown in FIG. 1, each intersection portion 38I is positioned so as to be substantially lateral to (i.e., to the side as viewed vertically) each of emitter electrodes 32. Hence, none of electrodes 32 significantly underlies any part of any intersection portion 38I. Portions 38I of each control electrode 38 are normally spaced approximately uniformly apart from one another along that electrode's rail 38R. Accordingly, intersection segments 38IA of each electrode 38 are normally spaced approximately uniformly apart from one another along longitudinal side 58A of that electrode's rail 38R while intersection segments 38IB of each electrode 38 are normally spaced approximately uniformly apart from one another along longitudinal side 58B of that electrode's rail 38R.

Intersection segments 38IA of each control electrode 38 typically extend longitudinally approximately parallel to one another. Intersection segments 38IB of each electrode 38 likewise typically extend longitudinally approximately parallel to one another. In the example of FIGS. 1–4, segments 38IA and 38IB of each electrode 38 also extend longitudinally approximately parallel to one another in the column direction and thus approximately perpendicular to that electrode's rail 38R. The longitudinal parallelism characteristic of segments 38IA or 38IB of each electrode 38 can, however, be achieved without having segments 38IA and 38IB of each electrode 38 all extend longitudinally generally in the column direction. For instance, segments 38IA and 38IB of each electrode 38 can be in a fishbone pattern.

Each of intersection segments 38IA and 38IB of each control electrode 38 consists of part of that electrode's main control portion 46 and, in the example of FIGS. 1–4, part of that electrode's gate portion 48. Especially see FIG. 4. The main control (46) part of each segment 38IA or 38IB of each electrode 38 normally extends from the main control (46) part of that electrode's rail 38R at least to a location where, as described further below, that segment 38IA or 38IB is continuous with corresponding linkage portion 38LA or 38LB. Each segment 38IA or 38IB of each electrode 38 may consist solely of part of that electrode's main control portion 46 and thus, as an alternative to the example of FIGS. 1–4, not include part of that electrode's gate portion 48. As a further alternative, each segment 38IA or 38IB of each electrode 38 may consist of part of that electrode's gate portion 48.

Exposure portions 38EA and 38EB of each control electrode 38 are spaced laterally apart from that electrode's rail 38R and intersection portions 38I. Each exposure portion 38EA fully overlies a corresponding one of electron-emissive zones 40A. Each exposure portion 38EB similarly fully overlies a corresponding one of electron-emissive zones 40B. The openings (again not shown here) which extend through each electrode 38 for exposing electron-emissive elements 50A or 50B of corresponding zone 40A or 40B are thus openings through corresponding exposure portion 38EA or 38EB. In the example of FIGS. 1–4, portions 38EA and 38EB are shaped laterally generally like rectangles of greater dimension in the column direction than in the row direction. Portions 38EA and 38EB can have other lateral shapes.

Each exposure portion 38EA or 38EB of each control electrode 38 consists solely of part of that electrode's gate portion 48. Accordingly, the openings in portions 38EA and 38EB are gate openings. Each portion 38EA or 38EB is substantially fully exposed through corresponding focus opening 54A or 54B.

Linkage portions 38LA and 38LB of each control electrode 38 are spaced laterally apart from that electrode's rail 38R. Each linkage portion 38LA or 38LB extends from a corresponding one of intersection segments 38IA or 38IB to a corresponding one of exposure portions 38EA or 38EB. Since each intersection portion 38I consists of a pair of segments 38IA and 38IB, each portion 38I is connected through a pair of linkage portions 38LA and 38LB respectively to a pair of exposure portions 38EA and 38EB. Each such pair of exposure portions 38EA and 38EB, along with the corresponding pair of linkage portions 38LA and 38LB, are situated on the same side (the left side in the orientation of FIGS. 1 and 4) of corresponding intersection portion 38I.

The two opposite sides of each linkage portion 38LA or 38LB in the row direction are generally prescribed as the locations at which the dimensions of the control-electrode material significantly increase in the column direction. In any event, linkage portions 38LA and 38LB do not include any of the control-electrode material overlying electron-emissive zones 40A and 40B. With the foregoing in mind, portions 38LA and 38LB are shaped laterally generally like rectangles in the example of FIGS. 1–4 but can have other lateral shapes. Each exposure portion 38EA or 38EB is normally of greater lateral dimension in the column direction than corresponding linkage portion 38LA or 38LB. However, each linkage portion 38LA or 38LB can be of substantially the same, or significantly greater, dimension in the column direction than corresponding exposure portion 38EA or 38EB.

As FIG. 1 shows, linkage portions 38LA and 38LB are positioned so that at least part of each portion 38LA or 38LB is lateral to each of emitter electrodes 32. In other words, at least part of each portion 38LA or 38LB is not underlain by any electrode 32. The large majority of the lateral area of each portion 38LA or 38LB is normally lateral to each electrode 32. Each portion 38LA or 38LB is also at least partially exposed, normally substantially fully exposed, through corresponding focus opening 54A or 54B.

Each linkage portion 38LA or 38LB of each control electrode 38 consists of part of the electrode's gate portion 48 and, in the example of FIGS. 1–4, part of that electrode's main control portion 46. Again, especially see FIG. 4. The main control (46) part of each portion 38LA or 38LB of each electrode 38 extends from the main control (46) part of corresponding intersection 38IA or 38IB to a location close to corresponding exposure portion 38EA or 38EB. Alternatively, each linkage portion 38LA or 38LB of each electrode 38 can consist solely of part of that electrode's gate portion 48.

By configuring control electrodes 38 in the preceding manner, each electrode 38 crosses over each emitter electrode 32 at substantially only three locations: (a) the site where rail 38R of that control electrode 38 crosses over that emitter electrode 32, (b) the site where exposure portion 38EA of that control electrode 38 overlies that emitter electrode 32, and (c) the site where exposure portion 38EB of that control electrode 38 overlies that emitter electrode 32. Aside from where rail 38R and exposure portions 38EA and 38EB of each control electrode 38 overlie each emitter electrode 32, none of that control electrode 38 overlies that emitter electrode 32. Accordingly, the area at which each control electrode 38 crosses over each emitter electrode 32 is relatively small.

Furthermore, emitter electrodes 32 are configured to neck down at locations where they cross over rails 38R of control electrodes 38. That is, the lateral dimension of each emitter electrode 32 in the row direction is reduced at locations where rails 38R cross over that electrode 32 as indicated in FIG. 1. This further reduces the area at which each control electrode 38 crosses over each electrode 32.

The cross-over capacitance of control electrodes 38 to emitter electrodes 32 decreases, typically in an approximately linear manner, as the control-electrode-to-emitter-electrode cross-over area decreases. Inasmuch as the control-electrode-to-emitter-electrode cross-over area is reduced to a low value by the electrode configuration employed in electron-emitting device 20, the control-electrode-to-emitter-electrode cross-over capacitance is likewise reduced to a low value in device 20. This enables the speed at which each of electron-emissive regions 40 is switched from one electron-emissive condition to another electron-emissive condition or to a non-emissive condition to be increased compared to an otherwise comparable electron-emitting device lacking the electrode configuration of device 20. Accordingly, device 20 has enhanced high-frequency performance. Also, device 20 consumes less power.

Light-emitting device, or faceplate structure, 22 consists of a generally flat electrically insulating faceplate 60, a two-dimensionsal array of rows and columns of laterally separated light-emissive regions 62, a patterned black matrix 64, and a thin light-reflective anode layer 66. Faceplate 60 is transparent, at least where visible light is intended to pass through faceplate 60 to produce an image on its exterior surface (the upper faceplate surface in FIG. 1) at the front of the flat-panel display. Light-emissive regions 62 lie on the interior surface of faceplate 60. Each region 62 is situated largely opposite a corresponding different one of electron-emissive regions 40. Since each region 40 consists of a pair of electron-emissive zones 40A and 40B, each light-emissive region 62 is situated largely opposite one zone 40A and one zone 40B as indicated in FIG. 3.

Black matrix 64, which also lies on interior faceplate surface, laterally surrounds each light-emissive region 62 and appears dark, largely black, as seen from the front of the display. Matrix 64 enhances the contrast of the display's image. In the example of FIGS. 2 and 3, matrix 64 extends vertically beyond light-emissive regions 62. Alternatively, regions 62 may extend vertically beyond matrix 64.

Anode layer 66 lies on light-emissive regions 62 and black matrix 64. Because layer 66 is light reflective, it reflects forward some of the initially rear-directed light emitted by regions 62 so as to enhance the display's efficiency. A high anode electrical potential, typically in the vicinity of 500–10,000 volts compared to the average of the various voltages applied to electron-emitting device 20, is furnished to layer 66 during display operation. Alternatively, layer 66 can be replaced with a transparent anode situated between faceplate 60, on one hand, and regions 62, on the other hand. The transparent anode can overlie or underlie matrix 64.

The flat-panel display of FIGS. 2 and 3 operates in the following manner. Appropriate voltages are applied to electrodes 32 and 38 to cause selected ones of electron-emissive regions 40 to emit electrons at desired emission levels. When one of regions 40 emits electrons, both of zones 40A and 40B in that region 40 normally emit electrons substantially simultaneously unless one of zones 40A and 40B has been disabled. The high anode potential applied to anode layer 66 attracts the emitted electrons to light-emitting device 22. Electron-focusing system 44 helps focus the electrons emitted by each region 40 on corresponding light-emissive region 62. Upon reaching device 22, the impinging electrons largely pass through anode layer 66 and strike regions 62, causing them to emit light which produces an image on the front of the display.

Display operation is generally the same in the alternative case where anode layer 66 is replaced with a transparent anode situated between faceplate 60, on one hand, and light-emissive regions 62 and black matrix 64, on the other hand, except that the electrons emitted by regions 40 strike light-emissive regions 62 without passing through the anode. The resultant light emitted by regions 62, however, passes through the anode to produce the display's image.

Fabrication of the display of FIGS. 2 and 3 is described below. During (and sometimes subsequent to) display fabrication, electrical short circuits occasionally occur between control electrodes 38, on one hand, and emitter electrodes 32, on the other hand, at locations where a control electrode 38 crosses over an emitter electrode 32. The configuration of control electrodes 38 facilitates removal of many of these control-electrode-to-emitter-electrode short-circuit defects.

Short circuits can be detected at various points during the fabrication of a flat-panel display that utilizes electron-emitting device 20. For example, short circuits are typically detected during testing of device 20 subsequent to device fabrication but before device 20 is assembled (through the outer wall) to light-emitting device 22 to form the display. Short-circuit detection can also be conducted after display assembly. With device 20 configured in the present manner, the short-circuit removal technique of the invention can be performed before or after display assembly to remove a control-electrode-to-emitter-electrode cross-over short-circuit defect. This corrective test is sometimes referred to as short-circuit repair. Removing or repairing short-circuit defects increases the yield of good displays and thus is important to display fabrication and test.

Ideally, a short-circuit defect is removed in such a manner that substantially no loss in performance is incurred. Nonetheless, display performance is often satisfactory when a few pixels or sub-pixels are partially or totally inoperative, provided that the remainder of the flat-panel display operates in the intended manner. Accordingly, removing a short-circuit defect in a way that causes part or all of a pixel or sub-pixel to be inoperative is often acceptable, again provided that the operation of the remainder of the display is largely unaffected and also provided that the number of removed short-circuit defects is not too high.

Control-electrode-to-emitter-electrode short-circuit defects can take various forms. An electron-emissive element 50A or 50B sometimes becomes electrically connected to corresponding exposure portion 38EA or 38EB. Because resistive layer 34 limits the current flowing through elements 50A and 50B, the amount of current flowing through an element 50A or 50B electrically connected to corresponding portion 38EA or 38EB is normally so small as not to have a significant effect on display operation. Accordingly, the connection of an element 50A or 50B to corresponding exposure portion 38EA or 38EB is normally not classified here as a short-circuit defect to be removed according to the invention. Nonetheless, the direct connection between an element 50A or 50B and the corresponding exposure portion 38EA or 38EB could be treated as a short-circuit defect for removal in the manner described below.

Control-electrode-to-emitter-electrode short-circuit defects of major concern are those in which a control electrode 38 becomes electrically connected to an emitter electrode 32 at more of an exposure portion 38EA or 38EB than just one or a few of its electron-emissive elements 50A or 50B. Such a short-circuit defect may arise due to a crack or cavity in dielectric layer 36 below one of exposure portions 38EA and 38EB. In that case, the conductive material of associated control electrode 38 typically extends from the exposure portion 38EA or 38EB down to underlying emitter electrode 32.

In the present invention, corrective test to repair control-electrode-to-emitter-electrode short-circuit defects, whether performed before or after display assembly, is initiated by examining electron-emitting device 20 to identify any control-electrode-to-emitter-electrode cross-over locations where a short-circuit defect appears to be present. The examination can be performed electrically, optically, or according to a combination of electrical and optical techniques. In a typical examination procedure, a global check is first performed to determine whether device 20 appears to have at least one control-electrode-to-emitter-electrode cross-over short circuit in the entire active device region. The global check entails placing a suitable voltage between control electrodes 38, on one hand, and emitter electrodes 32, on the other hand, and using a current-measuring device such as an ammeter to determine how much total current flows through electrodes 32 or 38. If the total current is below a threshold level, device 20 is classified as having no control-electrode-to-emitter-electrode short-circuit defect.

If the total current exceeds the threshold level, electron-emitting device 20 is classified as appearing to have one or more control-electrode-to-emitter-electrode cross-over short-circuit defects. Device 20 is then examined optically and/or electrically to determine the location of each control-electrode-to-emitter-electrode short circuit. For instance, the procedure and magnetic-sensing equipment described in Field et al, U.S. Pat. No. 6,118,279, can be utilized to determine each cross-over short-circuit location.

If a control-electrode-to-emitter-electrode cross-over short-circuit defect is determined to occur at an exposure portion 38EA or 38EB, a cut is made fully across corresponding linkage portion 38LA or 38LB to electrically separate short-circuited exposure portion 38EA or 38EB from associated intersection portion 38I and rail 38R, thereby removing short-circuited exposure portion 38EA or 38EB from the remainder of control electrode 38 having that portion 38EA or 38EB. Thick line 68 in FIG. 4 indicates a suitable location for such a cut through a linkage portion 38LB connected to a short-circuited exposure portion 38EB. The cut is made with a beam of focused energy, typical light (or optical) energy provided by a laser or focused lamp. If the short-circuit repair procedure is conducted before display assembly, the cut can be made by directing the beam of focused energy through the top or bottom side of electron-emitting device 20. If the repair procedure is performed after display assembly, the cut is normally made by directing the energy beam through the bottom side of device 20.

Passivation layer 42 is, as mentioned above, transparent. When a cut through a linkage portion 38LA or 38LB identified for use in short-circuit repair is to be made before display assembly by directing light on the identified linkage portion 38LA or 38LB from above electron-emitting device 20, light from above device 20 and thus from above short-circuited control electrode 38, is directed on device 20 so as to pass through focus opening 54A or 54B overlying that linkage portion 38LA or 38LB travelling roughly perpendicular to (either surface of) backplate 30. The light passes through passivation layer 40 to produce the cut at the identified linkage portion 38LA or 38LB.

As also mentioned above, backplate 30 and inter-electrode dielectric layer 36 are transparent while resistive layer 34 transmits a substantial fraction, typically 40–95%, of incident light. When a cut through a linkage portion 38LA or 38LB identified for use in short-circuit repair is to be made (before or after display assembly) by directing light on the identified linkage portion 38LA or 38LB from below electron-emitting device 20, light from below device 20 is directed toward backplate 30 travelling roughly perpendicular to backplate 30. By controlling the light so that it impinges on backplate 30 at a location below the identified linkage portion 38LA or 38LB, part of the incident light passes through backplate 30, resistive layer 34, and dielectric layer 36 to cut through that linkage portion 38LA or 38LB. In short, the configuration of control electrodes 38 greatly facilitates repairing control-electrode-to-emitter-electrode cross-over short-circuit defects regardless of whether the repair is done before or after display assembly.

FIG. 5 illustrates a plan view of part of the active portion of another electron-emitting device 70 designed according to the invention to reduce control-electrode-to-emitter-electrode cross-over capacitance and to facilitate control-electrode-to-emitter-electrode cross-over short-circuit repair. FIG. 6 presents a cross section of part of the active region of a flat-panel CRT display designed in accordance with the invention to utilize electron-emitting device 70 and light-emitting device 22 described above. The cross section of FIG. 3 for the flat-panel display of FIGS. 2 and 3 is also a cross section of the flat-panel display of FIG. 6. The cross sections of FIGS. 3 and 6 are taken perpendicular to each other.

The flat-panel display of FIGS. 6 and 3 is the same as that of FIGS. 2 and 3 except that electron-emitting device 70 replaces electron-emitting device 20. Hence, electron-emitting device 70 and light-emitting device 22 in the display of FIGS. 6 and 3 are connected together through an outer wall (not shown) to form sealed enclosure 24 maintained at a high vacuum. A spacer system (not shown) is situated between devices 70 and 22 inside enclosure 24 for resisting external forces exerted on the display and for maintaining a relatively uniform spacing between devices 70 and 22.

Electron-emitting device 70 contains backplate 30, emitter electrodes 32, resistive layer 34, inter-electrode dielectric layer 36, control electrodes 38, electron-emissive regions 40, passivation layer 42, and electron-focusing system 44. The principal difference between device 70 and electron-emitting device 20 is that control electrodes 38 are configured differently in device 70 than in device 20. Except for (a) the control-electrode configurational difference, (b) fabrication, test, and operational differences that result from the control-electrode configurational difference, and (c) other minor configurational differences caused by the control-electrode configurational difference, components 30, 32, 34, 36, 40, 42, and 44 in device 70 are configured, constituted, and function the same as in device 20.

FIG. 7 illustrates the layout of one of control electrodes 38 in electron-emitting device 70 as seen from enclosure 24 in the flat-panel display of FIGS. 6 and 3. As in electron-emitting device 20, each control electrode 38 in device 70 consists of main control portion 46 and one or more gate portions 48 that vertically adjoin main control portion 46. Similar to the example of device 20 illustrated in FIGS. 1–4, FIGS. 3 and 5–7 present an example in which each control electrode 38 of device 70 contains only one gate portion 48.

Each control electrode 38 in electron-emitting device 70 is arranged laterally to include rail 38, intersection portions 38I, first linkage portions 38LA, second linkage portions 38LB, first exposure portions 38EA, and second exposure portions 38EB configured, constituted, and operable the same as in electron-emitting device 20 except that one more intersection portion 38I is present in each electrode 38 of device 70 than in each electrode 38 of device 20. Accordingly, each intersection portion 38I in device 70 consists of a pair of segments 38IA and 38IB configured the same as in device 20.

In addition, each control electrode 38 in electron-emitting device 70 includes a group of laterally separated third linkage portions 38MA respectively corresponding to emitter electrodes 32 and a group of laterally separated fourth linkage portions 38MB respectively corresponding to electrodes 32. Linkage portions 38MA and 38MB of each electrode 38 are spaced laterally apart from that electrode's rail 38R. Each linkage portion 38MA or 38MB extends from a corresponding intersection segment 38IA or 38IB to a corresponding exposure portion 38EA or 38EB. Since each intersection portion 38I is formed with a pair of segments 38IA and 38IB, each intersection portion 38I except for one (the last one to the right in the exemplary layout of FIGS. 5 and 7) is connected through a pair of linkage portions 38MA and 38MB respectively to a pair of exposure portions 38EA and 38EB. As shown in FIGS. 5 and 7, each linkage portion 38MA or 38MB is situated on the opposite side of corresponding intersection segment 38IA or 38IB from where a corresponding linkage portion 38LA or 38LB is situated.

Linkage portions 38MA and 38MB are typically positioned symmetrically about exposure portions 38EA and 38EB relative to linkage portions 38LA and 38LB. Linkage portions 38MA and 38MB are illustrated in FIGS. 5 and 7 as rectangles of substantially the same dimensions as linkage portions 38LA and 38LB. Hence, linkage portions 38MA and 38MB are largely mirror images of linkage portions 38LA and 38LB. This mirror-image feature typically applies to linkage portions 38MA and 38MB relative to linkage portions 38LA and 38LB even when portions 38LA, 38LB, 38MA, and 38MB have lateral shapes other than rectangles. Aside from the symmetrical positioning characteristic and the mirror-image feature, linkage portions 38MA and 38MB have largely the same dimensional characteristics as linkage portions 38LA and 38LB. Consequently, each exposure portion 38EA or 38EB is normally of greater lateral dimension in the column direction than corresponding linkage portion 38MA or 38MB.

As shown in FIG. 5, linkage portions 38MA and 38MB are positioned so that at least part of each portion 38MA or 38MB is lateral to each of emitter electrodes 32. The large majority of the lateral area of each portion 38MA or 38MB is normally lateral to each electrode 32. As with each linkage portion 38LA or 38LB, each linkage portion 38MA or 38MB is also at least partly exposed, normally substantially fully exposed, through corresponding focus opening 54A or 54B.

Linkage portions 38MA and 38MB are constituted vertically in the same manner as linkage portions 38LA and 38LB. Each portion 38MA or 38MB of each control electrode 38 thereby consists of part of that electrode's gate portion 48 and, in the example of FIGS. 3 and 5–7, part of the electrode's main control portion 46.

None of linkage portions 38MA and 38MB overlies any of emitter electrodes 32. The area at which each control electrode 38 overlies each emitter electrode 32 in electron-emitting device 70 is the same as in electron-emitting device 20 and thus quite small. Accordingly, the control-electrode-to-emitter-electrode cross-over capacitance is substantially the same in device 70 as in device 20 and is therefore likewise quite small. Device 70 has enhanced high-frequency performance and reduced power consumption.

Linkage portions 38MA and 38MB provide redundancy to compensate for (potential) defects in linkage portions 38LA and 38LB. For instance, if any linkage portion 38LA or 38LB should be defective in such a way as to be incapable of providing sufficient electrical conductivity to associated exposure portion 38EA or 38EB, associated linkage portion 38MA or 38MB can provide the requisite electrical conductivity to that exposure portion 38EA or 38EB. Hence, the flat-panel display of FIGS. 6 and 3 can operate in the normal manner despite defects in certain of linkage portions 38LA and 38LB.

The flat-panel display of FIGS. 6 and 3 operates substantially the same as the display of FIGS. 2 and 3. Aside from providing redundancy to compensate for (or repair) defects in certain of linkage portions 38LA and 38LB, the presence of linkage portions 38MA and 38MB does not have any significant effect on display operation.

The configuration of control electrodes 38 in electron-emitting device 70 facilitates removal of control-electrode-to-emitter-electrode cross-over short-circuit defects in the same way as in electron-emitting device 20. The only difference is that two cuts are normally needed to remove a control-electrode-to-emitter-electrode cross-over short-circuit defect at one of exposure portions 38EA and 38EB in device 70 instead of one cut as occurs in device 20. One of the two cuts for removing a control-electrode-to-emitter-electrode cross-over short-circuit defect at an exposure portion 38EA or 38EB is made through linkage portion 38LA or 38LB on one side of that exposure portion 38EA or 38EB while the other cut is made through linkage portion 38MA or 38MB on the other side of that exposure portion 38EA or 38EB. Thick lines 68 and 72 in FIG. 7 indicate suitable locations for a pair of such cuts through a pair of linkage portions 38LB and 38MB on opposite sides of a short-circuited exposure portion 38EB.

The cuts through identified linkage portion 38MA or 38MB and associated linkage portion 38LA or 38LB are made with a beam of focused energy, typically light provided by a laser or focused lamp, in the same manner as described above for cutting through an identified linkage portion 38LA or 38LB in electron-emitting device 20. Analogous to when such short-circuit repair can be performed in the display of FIGS. 2 and 3, the short-circuit repair procedure to remove a control-electrode-to-emitter-electrode cross-over short-circuit defect at an exposure portion 38EA or 38EB in the display of FIGS. 6 and 3 can be done before display assembly by directing a beam of energy through the top or bottom side of electron-emitting device 70. The short-circuit repair procedure can also be done after display assembly by directing an energy beam through the bottom side of device 70. Except for the fact that two cuts are made instead of one, light is employed to make the two cuts in the same way as described above for the display of FIGS. 2 and 3.

Electron-emitting devices 20 and 70 can be modified in various ways. Instead of configuring control electrodes 38 in the manner shown in FIGS. 1, 4, 5, and 7 so that intersection segments 38IA and 38IB of each electrode 38 extend further away from its rail 38 (in the row direction) than do its linkage portions 38LA and 38LB, intersection portions 38IA and 38IB of each electrode 38 can extend approximately as far away from its rail 38R (again in the row direction) as do its linkage portions 38LA and 38LB. Each intersection segment 38IA or 38IB and corresponding linkage portion 38LA or 38LB are then shaped like an "L" rather than a sideways "T" or half "H".

Each intersection segment 38IA or 38IB and corresponding linkage portion 38LA or 38LB can be replaced with a composite curved intersection/linkage portion shaped, for example, like a quarter circle or quarter ellipse. Similarly, each segment 38IA or 38IB and corresponding portion 38LA or 38LB can be replaced with a composite intersection/linkage portion having another shape such as a quarter polygon having at least six, typically at least eight, sides. In the case where each segment 38IA or 38IB and corresponding portion 38LA or 38LB are replaced with a composite intersection/linkage portion, there may be no clear boundary between (a) the intersection/linkage part which intersects associated rail 38R and (b) the intersection/linkage part which performs the linkage function and is at a suitable location for being cut to separate corresponding exposure portion 38EA or 38EB from the remainder of control electrode 38 having that composite intersection/linkage portion. Each intersection portion 38IA or 38IB, corresponding linkage portion 38LA or 38LB, and corresponding linkage portion 38MA or 38MB can similarly be replaced with a composite intersection/linkage portion insofar as electron-emitting device 70 is being modified.

Electron-emissive zones 40B can be deleted from electron-emitting device 20 or 70 so that each electron-emitting region 40 is a single zone (40A). In that case, exposure portions 38EB, linkage portions 38LB, and intersection segments 38IB are deleted from control electrodes 38 in device 20 or 70 along with linkage portions 38MB insofar as device 70 is being modified. Intersection portions 38I (now consisting solely of segments 38IA) of each electrode 38 then extend laterally only from longitudinal side 58A of that electrode's rail 38R.

As a variation of the previous modification, rail 38R of each control electrode 38 can wind back and forth so that exposure portions 38EA of that electrode 38 are on one side of that electrode's rail 38R at certain locations and on the other side of that rail 38R at other locations. Linkage portions 38LA and intersection portions 38I (or 38IA) of each electrode 38 are then partially positioned at appropriate locations on one side of that electrode's rail 38R and partially positioned at appropriate locations on the other side of that rail 38R depending on where that electrode's exposure portions 38EA are variously located. This variation applies generally to electron-emitting device 20.

Each electron-emissive region 40 in electron-emitting device 20 or 70 may consist of three or more laterally separated electron-emissive zones. Each control electrode 38 then includes one or more additional groups of exposure portions respectively corresponding to emitter electrodes 32. The exposure portions in each additional group are situated lateral to longitudinal side 58A or 58B of rail 38R of that electrode 38. Each electrode 38 further includes one or more additional groups of linkage portions respectively corresponding to the additional exposure portions. Each additional linkage portion extends between a corresponding one of intersection portions 38I and the corresponding additional exposure portion in the same way as described above for exposure portions 38EA or 38EB, linkage portions 38LA or 38LB, and (insofar device 70 is being modified) linkage portions 38MA or 38MB.

Rather than having exposure portions 38EA, on one hand, and exposure portions 38EB, on the other hand, of each control electrode 38 be situated on opposite longitudinal sides of that electrode's rail 38R, portions 38EA and 38EB of each electrode 38 can all be situated on the same longitudinal side of that electrode's rail 38R. The same applies to linkage portions 38LA and 38LB and (insofar device 70 is being modified) linkage portions 38MA and 38MB. Segments 38IA and 38IB of each intersection portion 38I of electrode 38 are replaced with a single intersection portion extending to the side of that electrode's rail 38R where that rail's exposure portions 38EA and 38EB are located.

Electron-Emitting Device with Double-Rail Control Electrodes Having Cuttable Links FIG. 8 illustrates a plan view of part of the active portion of an electron-emitting device 80 designed in accordance with the invention to reduce control-electrode-to-emitter-electrode cross-over capacitance and to facilitate control-electrode-to-emitter-electrode short-circuit repair. FIGS. 8 and 9 present cross sections of part of the active region of a flat-panel CRT display designed in accordance with the invention to employ electron-emitting device 80 and oppositely situated light-emitting device 22. The cross sections of FIGS. 8 and 9 are taken perpendicular to each other.

The flat-panel display of FIGS. 8 and 9 is the same as that of FIGS. 2 and 3 except that electron-emitting device 80 replaces electron-emitting device 20. Accordingly, electron-emitting device 80 and light-emitting device 22 are connected together through an outer wall (not shown) to form sealed enclosure 24 maintained at a high vacuum. A spacer system (not shown) is situated between devices 80 and 22 inside enclosure 24.

Electron-emitting device 80 contains components 30, 32, 34, 36, 38, 40, 42, and 44. The principal difference between device 80 and electron-emitting device 20 is that control electrodes 38 are configured differently in device 80 than in device 20. Aside from (a) the control-electrode configurational difference, (b) fabrication, test, and operational differences arising from the control-electrode configurational difference, and (c) other minor configurational differences caused by the control-electrode configurational difference, components 30, 32, 34, 36, 40, 42, and 44 in device 80 are configured, constituted, and function the same as in device 20.

Each control electrode 38 in electron-emitting device 80 is arranged laterally to consist of a pair of laterally separated rails 38RA and 38RB, a group of laterally separated largely identical intersection portions 38J respectively corresponding to emitter electrodes 32, first linkage portions 38LA, second linkage portions 38LB, first exposure portions 38EA, and second exposure portions 38EB. FIG. 11 illustrates the layout of one control electrode 38 in device 80.

Rails 38RA and 38RB of each control electrode 38 extend longitudinally generally parallel to each other in the row direction. More particularly, rail 38RA has a pair of opposite longitudinal sides 58AO and 58AI extending generally parallel to each other in the row direction. Rail 38RB similarly has a pair of opposite longitudinal sides 58BO and 58BI extending generally parallel to each in the row direction. Longitudinal sides 58AO and 58BO of rails 38RA and 38RB of each electrode 38 constitute its outer longitudinal sides. Longitudinal sides 58AI and 58BI of rails 38RA and 38RB of each electrode 38 are internal to that electrode 38. Rails 38RA and 38RB all extend fully across the active portion of electron-emitting device 80. Hence, each of rails 38RA and 38RB crosses over all of emitter electrodes 32. Rails 38RB are slightly wider than rails 38RA in the example of FIGS. 8–11. Nonetheless, rails 38RA and 38RB can have other width relationships. For example, rails 38RA and 38RB can all be of substantially the same width.

Each of rails 38RA and 38RB of each control electrode 38 consists of part of that electrode's main control portion 46 and, in the example of FIGS. 8–11, part of that electrode's gate portion 48. The main control (46) part of each rail 38RA or 38RB extends substantially its entire length in the row direction and thus fully across the active portion of electron-emitting device 80. Although FIGS. 8–11 illustrate rails 38RA of each electrode 38 as including parts of that electrode's gate portion 48, rails 38RA and 38RB can consist solely of parts of that electrode's main control portion 46.

Intersection portions 38J of each control electrode 38 intersect with, and extend laterally away from, rails 38RA and 38RB, of that electrode 38 so as to be situated between those rails 38RA and 38RB. Each intersection portion 38J of each electrode 38 is continuous with longitudinal side 58AI of that electrode's rail 38RA and thereby extends laterally away from that rail 38RA. Each portion 38J of each electrode 38 is also continuous with longitudinal side 58BI of that electrode's rail 38RB and thereby extends laterally away from that rail 38RB. In the example of FIGS. 8–11, portions 38J of each electrode 38 extend longitudinally approximately parallel to one another in the column direction and thus approximately perpendicular to that electrode's rails 38RA and 38RB. Rails 38RA and 38RB and intersection portions 38J of each electrode 38 are thus in the shape of a ladder with portions 38J being the ladder's crosspieces.

As with intersection portions 38I in electron-emitting device 20, intersection portions 38J in electron-emitting device 80 are positioned so as to be substantially lateral to emitter electrodes 32. In other words, none of electrodes 32 significantly underlies any part of any portion 38J. See FIG. 8. Portions 38J of each control electrode 38 are normally spaced approximately uniformly apart from one another along rails 38RA and 38RB of that electrode 38. Nonetheless, portions 38J of each electrode 38 can have other spacings and need not extend approximately parallel to one another.

Each of intersection portions 38J of each control electrode 38 consists of part of that to electrode's main control portion 46 and, in the example of FIGS. 8–11, part of that electrode's gate portion 48. The main control (46) part of each intersection portion 32J of each electrode 38 normally extends from the main control (46) part of that electrode's rail 38RA to the main control (46) part of that electrode's rail 38RB. Each portion 38J of each electrode 38 may consist solely of part of that electrode's main control portion 46 and thus, as an alternative to the example of FIGS. 8–11, not include any part of that electrode's gate portion 48. As a further alternative, each portion 38J of each electrode 38 may consist solely part of that electrode's gate portion 48.

Exposure portions 38EA and 38EB and linkage portions 38LA and 38LB in electron-emitting device 80 are configured, constituted, and function the same as in electron-emitting device 20. Each linkage portion 38LA extends from a corresponding one of intersection portions 38J to a corresponding one of exposure portions 38EA. Each linkage portion 38LB similarly extends from a corresponding one of intersection portions 38J to a corresponding one of exposure portions 38EA. Each pair of exposure portions 38EA and 38EB corresponding to an intersection portion 38J are normally situated on the same side (the left side in the orientation of FIGS. 8 and 10) of that intersection portion 38J.

Exposure portions 38EA and 38EB, along with associated linkage portions 38LA and 38LB, of each control electrode 38 are spaced laterally apart from that electrode's rails 38RA and 38RB. In the example of FIGS. 8–11, exposure portions 38EB (along with corresponding linkage portions 38LB) of each control electrode 38 are closer to that electrode's rail 38RB than are exposure portions 38EA (along with corresponding linkage portions 38LA) of that electrode 38 to its rail 38RA. Exposure portions 38EA and 38EB of each electrode 38 can have other spatial relationships to that electrode's rails 38RA and 38RB. For example, the distance from exposure portions 38EB of each electrode 38 to its rail 38RB can be approximately the same as the distance from exposure portions 38EA of that electrode 38 to its rail 38RA.

By configuring control electrodes 38 of electron-emitting device 80 in the foregoing manner, each control electrode 38 here crosses over each emitter electrode 32 at substantially only four locations: (a) the two sites where rails 38RA and 38RB of that control electrode 38 cross over that emitter electrode 32, (b) the site where exposure portion 38EA of that control electrode 38 crosses over that emitter electrode 32, and (c) the site where exposure portion 38EB of that control electrode 38 crosses over that emitter electrode 32. Aside from where rails 38RA and 38RB of each control electrode 38 cross over each emitter electrode 32, none of that control electrode 38 besides its exposure portions 38EA and 38EB overlies that emitter electrode 32.

Also, emitter electrodes 32 neck down at locations where they cross over rails 38RA and 38RB. The net result is that the area at which each control electrode 38 crosses over each emitter electrode 32 is quite small. Accordingly, the control-electrode-to-emitter-electrode cross-over capacitance is quite small in electron-emitting device 80. This enables device 80 to have high switching speed and enhances the high-frequency performance. Device 80 also has reduced power consumption.

Cross-over short-circuit defects in which a control electrode 38 becomes short circuited to an emitter electrode 32 at one of exposure portions 38EA and 38EB are located and repaired in the same manner as described above for the flat-panel display of FIGS. 2 and 3. As with the configuration of control electrodes 38 in electron-emitting device 30, the configuration of electrodes 38 in electron-emitting device 80 facilitates removal of control-electrode-to-emitter-electrode cross-over short-circuit defects at exposure portions 38EA and 38EB.

Control-electrode-to-emitter-electrode cross-over short circuits can also occur along rails 38RA and 38RB of each control electrode 38. Implementing each electrode 38 with two rails 38RA and 38RB provides redundancy to enable a short-circuited segment of one of these rails 38RA and 38RB to be removed from that electrode 38.

The corrective test procedure described above for repairing control-electrode-to-emitter-electrode cross-over short-circuit defects in electron-emitting device 20 or 70 is extended here to include examining electron-emitting device 80 to determine whether a short circuit occurs at any location where any of rails 38RA and 38RB crosses over any of emitter electrodes 32. The examination can be done electrically or/and optically in, for example, the manner described above. If such a rail-to-emitter-electrode short circuit is determined to occur, a cut is made fully through short-circuited rail 38RA or 38RB on opposite sides of the short-circuited segment. Thick dashed lines 82 and 84 in FIG. 8 indicate locations for making two such cuts to remove a rail segment 86 at which illustrated rail 38RB is short circuited to an emitter electrode 32.

The cutting operation to remove short-circuited segment 86 of short-circuited rail 38RB is performed in a similar manner to the cutting operation described above for removing one of exposure portions 38EA and 38EB from its control electrode 38. A beam of focused energy, typically light energy provided from a laser or focused lamp, is directed on cut locations 82 and 84. For instance, light traveling approximately perpendicular to backplate 30 can be directed on locations 82 and 84 from below electron-emitting device 80, and thus from below control electrodes 38, before or after display assembly. Part of the light passes through backplate 30, resistive layer 34, and dielectric layer 36 to make the cuts at locations 82 and 84.

In the example of FIGS. 8–11, electron-focusing system 44 typically includes an upper layer of light-reflective metal that partly or fully overlies rails 38RA and 38RB at locations, such as locations 82 and 84, for cutting through a rail 38RA or 38RB to remove a short-circuited segment. Accordingly, it is generally unfeasible to perform the cutting operation by directing light toward cut locations 82 and 84 from above electron-emitting device 80 after it has been provided with system 44 but prior to display assembly. Nonetheless, the lateral configuration of system 44 can be modified so that it does not cover locations for cutting through rails 38RA and 38RB to remove short-circuited rail segments. In that case, the cutting operation can be performed after device 80 is fully fabricated but prior to display assembly by directing light on locations 82 and 84 from above device 80 and thus from above control electrodes 38.

Current normally flows in both rails 38RA and 38RB of each control electrode 38. However, rails 38RA and 38RB of each electrode 38 are usually of sufficient vertical cross section (width and thickness) that either of those rails 38RA and 38RB can carry all the current which normally flows through that electrode 38. After the cuts are made at locations 82 and 84 to remove short-circuited segment 86 from rail 38RB of electrode 38 illustrated in FIG. 8, the current flowing in that rail 38RB is diverted to the other rail 38RA by way of at least intersection portion 38J located immediately before segment 86. This current is then shunted through rail 38RA past segment 86 and returns at least partially to rail 38RB by way of at least intersection segment 38J located immediately after segment 86. Consequently, the flat-panel display of FIGS. 9 and 10 operates in the normal manner even though a short-circuit defect at segment 86 of illustrated rail 38RB has been repaired by removing segment 86 from illustrated control electrode 38.

FIG. 12 illustrates a plan view of part of the active portion of an electron-emitting device 90 designed according to the invention to reduce control-electrode-to-emitter-electrode cross-over capacitance and to facilitate control-electrode-to-emitter-electrode short-circuit repair. FIG. 13 presents a cross section of part of the active region of a flat-panel CRT display designed in accordance with the invention to utilize electron-emitting device 90 and light-emitting device 22. The cross section of FIG. 10 for the flat-panel display of FIGS. 9 and 10 is also a cross section of the flat-panel display of FIG. 13. The cross sections of FIGS. 10 and 13 are taken perpendicular to each other.

The flat-panel display of FIGS. 13 and 10 is the same as that of FIGS. 9 and 10 except the electron-emitting device 90 replaces electron-emitting device 80. Hence, device 90 and light-emitting device 22 are connected together through an outer wall (not shown) to form sealed enclosure 24 maintained at a high vacuum. A spacer system (also not shown) is situated between devices 90 and 22 inside enclosure 24.

Electron-emitting device 90 contains components 30, 32, 34, 36, 38, 40, 42, and 44. The principal difference between device 90 and electron-emitting device 80 is that control electrodes 38 are configured differently in device 90 than in device 80. Except for (a) the control electrode configurational difference, (b) fabrication, test, and operational differences that result from the control-electrode configurational difference, and (c) other minor configurational differences caused by the control-electrode configurational difference, components 30, 32, 36, 40, 42, and 44 in device 90 are configured, constituted, and function the same as in device 80 and thus as in electron-emitting device 20.

FIG. 14 illustrates the layout of one of control electrodes 38 in electron-emitting device 90 as seen from enclosure 24 in the display of FIGS. 13 and 10. Each electrode 38 in device 90 consists of main control portion 46 and one or more vertically adjoining gate portions 48 as in electron-emitting device 80 and thus likewise as in electron-emitting device 20. Similar to devices 80 and 20, FIGS. 10 and 12–14 present an example in which each electrode 38 contains only one gate portion 48.

Each control electrode 38 in electron-emitting device 90 is arranged laterally to include rails 38RA and 38RB, intersection portions 38J, first linkage portions 38LA, second linkage portions 38LB, first exposure portions 38EA, and second exposure portions 38EB configured, constituted, and operable the same as in electron-emitting device 80, except that one more intersection portion 38J is present in each electrode 38 of device 90 than in each electrode 38 of device 80.

In addition, each control electrode 38 in device 90 includes third linkage portions 38MA and fourth linkage portions 38MB. Each linkage portion 38MA or 38MB extends between a corresponding one of intersection portions 38J and a corresponding one of exposure portions 38EA or 38EB in the same way that each linkage portion 38MA or 38MB extends between corresponding intersection portion 38I and corresponding exposure portion 38EA or 38EB in electron-emitting device 70. Linkage portions 38MA and 38MB in device 90 are also positioned laterally with respect to linkage portions 38LA and 38LB in the same way as in device 70.

Linkage portions 38MA and 38MB in electron-emitting device 90 provide redundancy to compensate for (potential) defects in linkage portions 38LA and 38LB in the same way as described above for electron-emitting device 70. Repair of control-electrode-to-emitter-electrode short-circuit defects at exposure portions 38EA and 38EB in device 90 is performed in the way described above for device 70. Aside from this, device 90 is basically the same as electron-emitting device 80 and achieves the same reduction in control-electrode-to-emitter-electrode cross-over capacitance as device 80. The repair of control-electrode-to-emitter-electrode short-circuit defects along rails 38RA and 38RB in device 90 is performed the same as in device 80.

Electron-emitting devices 80 and 90 can be modified in various ways. Electron-emissive zones 40B can be deleted from device 80 or 90 along with exposure portions 38EB and linkage portions 38LB and, insofar as device 90 is being modified, linkage portions 38MB. Each electron-emissive region 40 in device 80 or 90 then consists of a single zone.

Exposure portions 38EA or/and 38EB along with linkage portions 38LA or/and 38LB and, insofar electron-emitting device 90 is being modified, linkage portions 38MA or/and 38MB of each control electrode 38 in device 80 or 90 can be situated outside that electrode's rail 38RA or/and that electrode's rail 38RB, i.e., beyond outer longitudinal side 58AO of that electrode's rail 38RA or/and beyond outer longitudinal side 58BO of that electrode's rail 38RB. Somewhat analogous to how each intersection portion 38I consists of a pair of segments 38IA and 38IB in electron-emitting device 20 or 70, each intersection portion 38J of each control electrode 38 in this modification then consists of (a) a main segment extending between that electrode's rails 38RA and 38RB and (b) one or two additional segments extending laterally away from side 58AO of that electrode's rail 38RA or/and side 58BO of that electrode's rail 38RB.

Each electron-emissive region 40 in electron-emitting device 80 or 90 may consist of three or more laterally separated electron-emissive zones. In that case, each control electrode 38 includes (a) one or more additional groups of exposure portions respectively corresponding to emitter electrodes 32 and (b) one or more additional groups of linkage portions respectively corresponding to the additional exposure portions. Each additional linkage portion extends between a corresponding one of intersection portions 38J and the corresponding additional exposure portion in the way described above for exposure portions 38EA and 38EB, linkage portions 38LA and 38LB, and (insofar as device 90 is being modified) linkage portions 38MA and 38MB. This modification can be combined in various ways with the modification described in the immediately preceding paragraph.

Each control electrode 38 may contain three or more laterally separated rails extending longitudinally generally in the row direction. Although exposure portions 38EA and 38EB, linkage portions 38LA and 38LB, and (insofar as device 90 is being modified) linkage portions 38MA and 38MB can be situated between two consecutive ones of the rails, this modification can generally be combined with either or both of the modifications described in the two immediately preceding paragraphs. In any event, intersection portions analogous to intersection portions 38J are situated between each pair of consecutive rails.

Electron-Emitting Device with Emitter Electrodes Having Cuttable Links

Instead of providing control electrodes 38 with lateral patterning (or configuration) that facilitates repair of control-electrode-to-emitter-electrode cross-over short-circuit defects, emitter electrodes 32 can be laterally patterned to facilitate repairing control-electrode-to-emitter-electrode cross-over short-circuit defects. When emitter electrodes are so patterned, they typically extend longitudinally generally in the row direction, i.e., the direction in which control electrodes 38 now extend.

More particularly, each of FIGS. 1, 5, 8, and 12 can represent the plan view of part of the active portion of an electron-emitting device having emitter electrodes configured in accordance with the invention to facilitate control-electrode-to-emitter-electrode cross-over short-circuit repair. In this alternative interpretation of FIGS. 1, 5, 8, and 12, reference symbol "38" represents emitter electrodes situated on backplate 30 and extending longitudinally generally in the row direction. Reference symbol "32" then represents control electrodes situated on interelectrode dielectric layer 36 and extending longitudinally generally in the column direction and thus generally perpendicular to emitter electrodes 38. Subject to ignoring the dashed lines labeled with reference symbol "48", the plan views of FIGS. 4, 7, 11, and 14 can represent the layouts of emitter electrodes 38 in this alternative interpretation of FIGS. 1, 5, 8, and 12.

Each emitter electrode 38 in the alternative interpretation of FIG. 1 consists of rail 38R, intersection portions 38I respectively corresponding to control electrodes 32, first linkage portions 38LA respectively corresponding to control electrodes 32 and thus respectively corresponding to intersection portions 38I, second linkage portions 38LB respectively corresponding to control electrodes 32, a group of laterally separated largely identical first emitter-coupling portions 38EA respectively corresponding to control electrodes 32, and a group of laterally separated largely identical second emitter-coupling portions 38EB respectively corresponding to control electrodes 32. Reference symbols "38R", "38I", "38LA", and "38LB" thus represent parts of emitter electrodes 38 in the alternative interpretation of FIG. 1 but otherwise have the same meanings as in the original interpretation of FIG. 1. In the alternative interpretation of FIG. 1, reference symbols "38EA" and "38EB" represent emitter-coupling portions of emitter electrodes 38 rather than exposure portions of control electrodes 38 as occurs in the original interpretation of FIG. 1.

Each emitter electrode 38 in the alternative interpretation of FIG. 5 contains rail 38R, intersection portions 38I, first linkage portions 38LA, second linkage portions 38LB, first emitter-coupling portions 38EA, and second emitter-coupling portions 38EB as in the alternative interpretation of FIG. 1, except that one more intersection portion 38I is present in each emitter electrode 38 in the alternative interpretation of FIG. 5 than in the alternative interpretation of FIG. 1. In addition, each emitter electrode 38 in the alternative interpretation of FIG. 5 includes third linkage portions 38MA respectively corresponding to control electrodes 32, and fourth linkage portions 38MB respectively corresponding to control electrodes 32. Reference symbols "38MA" and "38MB" therefore represent parts of emitter electrodes 38 in the alternative interpretation of FIG. 5 but otherwise have the same meanings as in the original interpretation of FIG. 5.

Each emitter electrode 38 in the alternative interpretation of FIG. 8 contains a pair of rails 38RA and 38RB, intersection portions 38J respectively corresponding to control electrodes 32, first linkage portions 38LA, second linkage portions 38LB, first emitter-coupling portions 38EA, and second emitter-coupling portions 38EB. Each emitter electrode 38 in the alternative interpretation of FIG. 12 contains rails 38RA and 38RB, intersection portions 38J, first linkage portions 38LA, second linkage portions 38LB, first emitter-coupling portions 38EA, and second emitter-coupling portions 38EB as in the alternative interpretation of FIG. 8 except that one more intersection portion 38J is present in the alternative interpretation of FIG. 12 than in the alternative interpretation of FIG. 8. Reference symbols "38RA", "38RB", and "38J" thus represent parts of emitter electrodes 38 in the alternative interpretation of FIGS. 8 and 12 but otherwise have the same meanings as in the original interpretations of FIGS. 8 and 12. In addition, each emitter electrode 38 in the alternative interpretation of FIG. 12 includes third linkage portions 38MA and fourth linkage portions 38MB.

In the alternative interpretation of FIGS. 1, 5, 8, and 12, each electron-emissive zone 40A or 40B is situated over a corresponding emitter-coupling portion 38EA or 38EB and is electrically coupled to that portion 38EA or 38EB through an underlying part of resistive layer 34. Each control electrode 32 in the alternative interpretation of FIGS. 1, 5, 8, and 12 overlies portions 40A and 40B of one electron-emissive region 40 electrically coupled to each emitter electrode 38. Each control electrode 32 crosses over all of emitter-electrode rails 38R in the alternative interpretation of FIGS. 1 and 5. In the alternative interpretation of FIGS. 8 and 12, each control electrode 32 crosses over all of emitter-electrode rails 38RA and 38RB.

Each control electrode 32 in the alternative interpretation of FIGS. 1, 5, 8, and 12 consists of main control portion 46 and one or more adjoining gate portions 48. As in the original interpretation of FIGS. 1, 5, 8, and 12, gate portions 48 may extend over or under main control portions 46 in the alternative interpretation of FIGS. 1, 5, 8, and 12. The portions of control electrodes 32 having openings for exposing electron-emissive elements 50A and 50B normally consist only of gate portions 48 in the alternative interpretation of FIGS. 1, 5, 8, and 12.

Subject to the preceding configurational differences, the electron-emitting devices in the alternative interpretation of FIGS. 1, 5, 8, and 12 function substantially the same, provide substantially the same advantages, and are otherwise configured substantially the same as described above for electron-emitting devices 20, 70, 80, and 90 in the original interpretation of FIGS. 1, 5, 8, and 12. The electron-emitting devices in the alternative interpretation of FIGS. 1 and 5 have the same control-electrode-to-emitter-electrode cross-over area as devices 20 and 70 in the original interpretation of FIGS. 1 and 5. The electron-emitting devices in the alternative interpretations of FIGS. 8 and 12 have the same control-electrode-to-emitter-electrode cross-over area as devices 80 and 90 in the original interpretations of FIGS. 8 and 12. The control-electrode-to-emitter-electrode cross-over capacitance is thereby reduced to a low value in the electron-emitting devices of the alternative interpretations of FIGS. 1, 5, 8, and 12 so that these alternative electron-emitting devices have enhanced high frequency performance and reduced power consumption.

Each of the electron-emitting devices in the alternative interpretations of FIGS. 1, 5, 8, and 12 is combined with light-emitting device 22 to form a flat-panel CRT display in substantially the same way as in the original interpretation of FIGS. 1, 5, 8, and 12. As a result, the control-electrode-to-emitter-electrode short-circuit repair can be performed before or after display assembly in substantially the same was as described above for electron-emitting devices 20, 70, 80, and 90 in the original interpretation of FIGS. 1, 5, 8, and 12 except that cuts for removing control-electrode-to-emitter-electrode cross-over short-circuit defects are now made through certain portions of emitter electrodes 38.

Item 68 in FIGS. 4 and 11 can represent a location for making a cut to repair a control-electrode-to-emitter-electrode cross-over short-circuit defect at a location where one of control electrodes 32 crosses over an emitter-coupling portion 38EB of one of emitter electrodes 38 in the alternative interpretation of FIGS. 1 and 8. Items 68 and 72 in FIGS. 7 and 14 can similarly represent locations for making a pair of cuts to repair a control-electrode-to-emitter-electrode cross-over short-circuit defect at a location where a control electrode 32 crosses over an emitter-coupling portion 38EB of an emitter electrode 38 in the alternative interpretation of FIGS. 5 and 12. Items 82 and 84 in FIGS. 8 and 12 can represent locations for making a pair of cuts to remove a segment of a rail 38RB in order to repair a control-electrode-to-emitter-electrode cross-over short-circuit defect at a location where a control electrode 32 crosses over that rail 38RB.

Electron-Emission Structural Detail, Focus Structure, Display Fabrication, and Variations FIG. 15 illustrates a cross section of a typical implementation of part of electron-emitting device 20 in FIGS. 1–4 or electron-emitting device 80 in FIGS. 8–11. The cross section of FIG. 15 is centered on one of electron-emissive zones 40A. In the implementation of FIG. 15, electron-emissive elements 52A of illustrated zone 40A are shaped generally like cones. Elements 52A could as well be illustrated as shaped generally like filaments.

Each electron-emissive element 52A in the implementation of FIG. 15 is situated largely in an opening 100A extending through inter-electrode dielectric layer 36 down to resistive layer 34. Gate openings 102A extend through illustrated exposure portion 38EA of control electrode 38. Each element 52A is exposed through a corresponding one of gate openings 102A. Dielectric layer 36 and each exposure portion 38B are configured to implement each electron-emissive zone 40B in the same manner as shown in FIG. 15 for configuring layer 36 and illustrated exposure portion 38A to implement illustrated zone 40A.

In the implementation of FIG. 15, electron-focusing system 44 consists of a base focusing structure 104 and an overlying focus coating 106. Base focusing structure 104 lies on passivation layer 42. In the absence of layer 42, structure 104 would lie on dielectric layer 36 and extend over control electrodes 38. The lateral pattern for system 44 is established in structure 104.

Base focusing structure 104 consists of electrically insulating and/or electrically resistive material. FIG. 15 illustrates an example in which structure 104 is formed solely with insulating material. Structure 104 typically consists of photopolymerized polyimide. To the extent that structure 104 includes resistive material, structure 104 is configured and constituted so as to avoid electrically interconnecting any of control electrodes 38.

Focus coating 106 lies on top of base focusing structure 104 and extends partway down the sidewalls of structure 104 into focus openings 54A and 54B such as focus opening 54A illustrated in FIG. 15. Focus coating 106 can extend substantially all the way down the sidewalls of structure 104 provided that coating 106 is electrically insulated from control electrodes 38. Coating 106 consists of electrically non-insulating material, normally electrically conductive material such as metal. In any event, coating 104 is of lower average electrically resistivity, normally considerably lower average electrically resistivity, than structure 104. The focus potential is provided to coating 106.

By modifying FIG. 15 to include a linkage portion 38MA positioned symmetrically opposite illustrated linkage portion 38LA, FIG. 15 would depict a cross section of a typical implementation of part of electron-emitting device 70 in FIGS. 3 and 5–7 or electron-emitting device 90 in FIGS. 10 and 12–14. Subject to furnishing emitter electrodes 32, rather than control electrodes 38, with lateral patterning that facilitates control-electrode-to-emitter-electrode cross-over short-circuit repair and reduces control-electrode-to-emitter-electrode cross-over capacitance in accordance with the invention, FIG. 15 also generally represents how an electron-emitting device generally appears in the alternative interpretation of FIGS. 1, 5, 8, and 12.

Each of the present flat-panel CRT displays is fabricated in generally the following manner. For a display that includes electron-emitting device 20, 70, 80, or 90, light-emitting device 22 is fabricated separately from device 20, 70, 80, or 90. When a spacer system is employed in the flat-panel display, the spacer system is mounted on device 22 or on device 20, 70, 80, or 90. The display is hermetically sealed through the above-mentioned outer wall in such a way that the assembled, sealed display is at a very low internal pressure, typically no more than $10^{-6}$–$10^{-5}$ torr. The same procedure is employed when the electron-emitting device is implemented according to the alternative interpretation of FIG. 1, 5, 8, or 12.

The fabrication of electron-emitting device 20, 70, 80, or 90 is initiated by forming emitter electrodes 32 on backplate 30. A blanket precursor to resistive layer 34 is deposited over electrodes 32 and backplate 30. A blanket precursor to dielectric layer 36 is deposited on the blanket resistive layer. Control electrodes 38, electron-emissive regions 40, and passivation layer 42 are then formed according to any of a number of process sequences. In forming passivation layer 42, the blanket precursors to dielectric layer 36 and resistive layer 34 are patterned to respectively create layers 36 and 34. Depending on whether, and how, resistive layer 34 is patterned, other process sequences can be employed to form device 20, 70, 80, or 90.

Base focusing structure 104 is formed on top of the structure in the desired pattern for electron-focusing system 44. Finally, focus coating 106 is deposited on structure 104. Getter material (not shown) may be provided at various locations in electron-emitting device 20, 70, 80, or 90. The process utilized to fabricate device 20, 70, 80, or 90 is also employed when the electron-emitting device is implemented according to the alternative interpretation of FIG. 1, 5, 8, or 12 subject to reference symbols "38" and "32" now respectively representing the emitter and control electrodes.

Fabrication of light-emitting device 22 involves forming black matrix 64 on faceplate 60. Light-emissive material, typically phosphor, is introduced into openings in matrix 64 to create light-emissive regions 62. Light-reflective anode layer 66 is subsequently deposited over regions 62 and matrix 64. Getter material may be provided at various locations in device 22.

Directional terms such as "lateral", "above", and "below" have been employed in describing the present invention to establish a frame of reference by which the reader can more easily understand how the various parts of the invention fit together. In actual practice, the components of a flat-panel CRT display may be situated at orientations different from that implied by the directional terms used here. Inasmuch as directional terms are used for convenience to facilitate the description, the invention encompasses implementations in which the orientations differ from those strictly covered by the directional terms employed here.

The terms "row" and "column" are arbitrary relative to each other and can be reversed. Also, taking note of the fact that lines of an image are typically generated in what is now termed the row direction, control electrodes 38 and emitter electrodes 32 can be rotated one-quarter turn so that control electrodes 38 extend in what is now termed the row direction while emitter electrodes 32 extend in what is now termed the column direction.

While the invention has been described with reference to particular embodiments, this description is solely for the purpose of illustration and is not to be construed as limiting the scope of the invention claimed below. For example, each control electrode 38 may be of substantially only a single thickness throughout that electrode's entire lateral area. The width of each rail 38R, 38RA, or 38RB may vary along its length. In particular, each rail 38R, 38RA, or 38RB may neck down where it crosses over an emitter electrode 32 or, in the alternative interpretation of FIGS. 1, 5, 8, and 12, where it crosses under a control electrode 32. The spacer system situated between light-emitting device 22 and electron-emitting device 20, 70, 80, or 90 or the corresponding electron-emitting device in the alternative interpretation of any of FIGS. 1, 5, 8, and 12 can be deleted by making backplate 30 and faceplate 60 sufficiently thick. In some embodiments, electron-focusing system 44 or/and resistive layer 34 can be deleted.

Backplate 30 can be opaque, thereby normally giving up the ability to perform control-electrode-to-emitter-electrode cross-over short-circuit repair prior to display assembly using a laser or focused lamp. Resistive layer 34 and/or dielectric layer 36 can also be opaque. In that case, control-electrode-to-emitter-electrode cross-over short-circuit repair using a laser or focused lamp can generally only be performed prior to display assembly on electron-emitting device 20, 70, 80, or 90. When the electron-emitting device is implemented as in the alternative interpretation of FIG. 1, 5, 8, or 12, control-electrode-to-emitter-electrode cross-over short-circuit repair using a laser or focused lamp can still generally be performed subsequent to display assembly providing that backplate 30 transmits sufficient light to perform the repair.

Field emission includes the phenomenon generally termed surface conduction emission. Various modifications and applications may thus be made by those skilled in the art without departing from the true scope and spirit of the invention as defined in the appended claims.

We claim:

1. A structure comprising:

an emitter electrode extending longitudinally generally in a first lateral direction;

an electron-emissive region comprising a main electron-emissive zone that contains a multiplicity of main electron-emissive elements situated over part of the emitter electrode; and a control electrode comprising (a) a primary rail crossing over the emitter electrode and extending longitudinally generally in a second lateral direction different from the first lateral direction, (b) a major intersection portion continuous with, and extending laterally away from, the rail, (c) a main exposure portion largely overlying the electron-emissive zone and having a multiplicity of openings through which the electron-emissive elements are exposed, and (d) a main linkage portion extending between the intersection and exposure portions.

2. A structure as in claim 1 wherein at least part of the linkage portion is lateral to the emitter electrode.

3. A structure as in claim 1 wherein the intersection portion is lateral to the emitter electrode.

4. A structure as in claim 1 wherein the exposure portion is of greater dimension in the first lateral direction than the linkage portion.

5. A structure as in claim 1 wherein the emitter electrode necks down laterally where it crosses under the rail.

6. A structure as in claim 1 wherein:

the rail comprises at least part of a main control portion; and the exposure portion comprises at least part of a gate portion vertically thinner than the main control portion.

7. A structure as in claim 6 wherein each of the intersection and linkage portions comprises part of the main control portion.

8. A structure as in claim 1 wherein the rail has a pair of opposite longitudinal sides extending generally in the second lateral direction, the intersection portion being continuous with at least one of the rail's longitudinal sides.

9. A structure as in claim 1 wherein the lateral directions are approximately perpendicular to each other.

10. A structure as in claim 1 further including a dielectric layer overlying the emitter electrode, the electron-emissive elements situated largely in openings extending through the dielectric layer, the control electrode overlying the dielectric layer.

11. A structure as in claim 1 wherein:

the electron-emissive region includes an additional electron-emissive zone spaced laterally apart from the main electron-emissive zone and containing a multiplicity of additional electron-emissive elements situated over part of the emitter electrode; and the control electrode includes (a) an additional exposure portion largely overlying the additional electron-emissive zone and having a multiplicity of openings through which the additional electron-emissive elements are exposed and (b) an additional linkage portion extending between the intersection portion and the additional exposure portion.

12. A structure as in claim 11 wherein at least part of each linkage portion is lateral to the emitter electrode.

13. A structure as in claim 11 wherein:

the rail has a pair of opposite longitudinal sides extending in the second lateral direction; and the intersection portion comprises (a) a main intersection segment continuous with the main linkage portion and one of the rail's longitudinal sides and (b) an additional intersection portion continues with the additional linkage portion and the other of the rail's longitudinal sides.

14. A structure as in claim 11 wherein:

the rail has a pair of opposite longitudinal sides extending generally in the second lateral direction; and both exposure portions are situated beyond one of the rail's longitudinal sides.

15. A structure as in claim 1 further including (a) a further intersection portion continuous with, and extending laterally away from, the rail and (b) a further linkage portion extending between the further intersection portion and the exposure portion.

16. A structure as in claim 1 wherein:

the control electrode includes a further rail extending longitudinally generally in the second lateral direction; and the intersection portion is continuous with, and extends laterally away from, the further rail so as to be at least partly located between the rails.

17. A structure as in claim 16 wherein the exposure portion is situated between the rails.

18. A structure as in claim 16 wherein at least part of the linkage portion is lateral to the emitter electrode.

19. A structure as in claim 16 wherein the intersection portion is lateral to the emitter electrode.

20. A structure as in claim 16 wherein:

the electron-emissive region includes an additional electron-emissive zone spaced apart from the main electron-emissive zone and containing a multiplicity of additional electron-emissive elements situated over part of the emitter electrode; and the control electrode includes (a) an additional exposure portion largely overlying the additional electron-emissive zone and having a multiplicity of openings through which the additional electron-emissive elements are exposed and (b) an additional linkage portion extending between the intersection portion and the additional exposure portion.

21. A structure as in claim 20 wherein both exposure portions are situated between the rails.

22. A structure as in claim 20 wherein both exposure portions are situated to one side of the intersection portion.

23. A structure as in claim 20 wherein at least part of each linkage portion is lateral to the emitter electrode.

24. A structure as in claim 16 wherein the control electrode includes (a) a further intersection portion continuous with, and extending laterally away from, both rails so as to be at least partly located between the rails and (b) a further linkage portion extending between the further intersection portion and the exposure portion.

25. A structure comprising:

a plurality of laterally separated emitter electrodes extending longitudinally generally in a first lateral direction;

a plurality of laterally separated electron-emissive regions each comprising a main electron-emissive zone that contains a multiplicity of main electron-emissive elements situated over part of a corresponding one of the emitter electrodes; and a control electrode comprising (a) a primary rail crossing over the emitter electrodes and extending longitudinally generally in a second lateral direction different from the first lateral direction, (b) a plurality of major intersection portions continuous with, and extending laterally away from, the rail, (c) a plurality of main exposure portions each largely overlying a corresponding one of the electron-emissive zones and having a multiplicity of openings through which the electron-emissive elements of the corresponding electron-emissive zone are exposed, and (d) a plurality of main linkage portions each extending between a corresponding one of the intersection portions and a corresponding one of the exposure portions.

26. A structure as in claim 25 further including a light-emitting device comprising a plurality of laterally separated light-emissive regions each situated opposite a corresponding different one of the electron-emissive regions for emitting light to produce at least part of different dot of an image upon being struck by electrons emitted by the corresponding electron-emissive region.

27. A structure as in claim 25 wherein:

each electron-emissive region includes an additional electron-emissive zone spaced laterally apart from that electron-emissive region's main electron-emissive zone and containing a multiplicity of additional electron-emissive elements situated over part of the corresponding emitter electrode; and the control electrode includes (a) a plurality of additional exposure portions each largely overlying a corresponding one of the additional electron-emissive zones and having a multiplicity of openings through which the additional electron-emissive elements of the corresponding additional electron-emissive zone are exposed and (b) a plurality of additional linkage portions each extending between a corresponding one of the intersection portions and a corresponding one of the additional exposure portions.

28. A structure as in claim 27 wherein:

the rail has a pair of opposite longitudinal sides extending generally in the second lateral direction; and each intersection portion comprises (a) a main intersection segment continuous with a corresponding one of the main linkage portions and one of the rail's longitudinal sides and (b) an additional intersection segment continuous with a corresponding one of the additional linkage portions and the other of the rail's longitudinal sides.

29. A structure as in claim 27 wherein:

the rail has a pair of opposite longitudinal sides extending generally in the second lateral direction; and all of the exposure portions are situated beyond one of the rail's longitudinal sides.

30. A structure as in claim 27 further including a light-emitting device comprising a plurality of laterally separated light-emissive regions each situated opposite a corresponding different one of the electron-emissive regions for emitting light to produce at least part of different dot of an image upon being struck by electrons emitted by the corresponding electron-emissive region.

31. A structure as in claim 25 wherein the control electrode includes at least one further linkage portion, each extending between one of the exposure portions and one of the intersection portions other than the intersection portion corresponding to that exposure portion.

32. A structure as in claim 25 wherein:

the control electrode includes a further rail extending generally in the second lateral direction; and the intersection portions are continuous with, and extend laterally away from, the further rail so that each intersection portion is at least partly located between the rails.

33. A structure as in claim 32 further including a light-emitting device comprising a plurality of laterally separated light-emissive regions each situated opposite a corresponding different one of the electron-emissive regions for emitting light to produce at least part of different dot of an image upon being struck by electrons emitted by the corresponding electron-emissive region.

34. A structure as in claim 32 wherein:

each electron-emissive region includes an additional electron-emissive zone containing a multiplicity of additional electron-emissive elements situated over part of the corresponding emitter electrode; and the control electrode includes (a) a plurality of additional exposure portions each largely overlying a corresponding one of the additional electron-emissive zones and having a multiplicity of openings through which the additional electron-emissive elements of the corresponding additional electron-emissive zone are exposed and (b) a plurality of additional linkage portions each extending between a corresponding one of the intersection portions and a corresponding one of the additional exposure portions.

35. A structure as in claim 34 further including a light-emitting device comprising a plurality of laterally separated light-emissive regions each situated opposite a corresponding different one of the electron-emissive regions for emitting light to produce at least part of different dot of an image upon being struck by electrons emitted by the corresponding electron-emissive region.

36. A structure as in claim 32 wherein the control electrode includes at least one further linkage portion, each extending between one of the exposure portions and one of the intersection portions other than the intersection portion corresponding to that exposure portion.

37. A structure comprising:

an emitter electrode comprising (a) a primary rail extending longitudinally generally in a first lateral direction, (b) a major intersection portion continuous with, and extending laterally away from, the rail, (c) a main emitter-coupling portion, and (d) a main linkage portion extending between the intersection and emitter-coupling portions;

an electron-emissive region comprising a main electron-emissive zone that contains a main electron-emissive element situated over the emitter-coupling portion; and a control electrode overlying the electron-emissive zone, having an opening through which the electron-emissive element is exposed, crossing over the rail, and extending longitudinally generally in a second lateral direction different from the first lateral direction.

38. A structure as in claim 37 wherein at least part of the linkage portion is lateral to the control electrode.

39. A structure as in claim 37 wherein the intersection portion is lateral to the control electrode.

40. A structure as in claim 37 wherein the electron-emissive zone contains at least one additional main electron-emissive element situated over the emitter-coupling portion and exposed through an opening in the control electrode.

41. A structure as in claim 37 wherein:

the emitter electrode includes a further rail extending longitudinally generally in the first lateral direction; and the intersection portion is continuous with, and extends laterally away from, the further rail so as to be at least partly located between the rails.

42. A structure as in claim 41 wherein the emitter-coupling portion is situated between the rails.

43. A method comprising providing a structure in which an emitter electrode extends longitudinally generally in a first lateral direction, an electron-emissive region comprises a main electron-emissive zone that contains a multiplicity of main electron-emissive elements situated over part of the emitter electrode, and a control electrode comprises (a) a primary rail crossing over the emitter electrode and extending longitudinally generally in a second lateral direction different from the first lateral direction, (b) a major intersection portion continuous with, and extending laterally away from, the rail, (c) a main exposure portion largely overlying the electron-emissive zone and having a multiplicity of openings through which the electron-emissive elements are exposed, and (d) a main linkage portion extending between the intersection and exposure portions.

44. A method as in claim 43 wherein at least part of the linkage portion is lateral to the emitter electrode.

45. A method as in claim 43 wherein the intersection portion is lateral to the emitter electrode.

46. A method as in claim 43 wherein:

the rail comprises at least part of a main control portion; and the exposure portion comprises at least part of a gate portion vertically thinner than the main control portion.

47. A method as in claim 43 wherein the providing act includes providing the structure with a dielectric layer that overlies the emitter electrode such that the electron-emissive elements are situated largely in openings extending through the dielectric layer and such that the control electrode overlies the dielectric layer.

48. A method as in claim 43 further including:

examining the structure to determine whether the control electrode appears to be electrically short circuited to the emitter electrode at the exposure portion; and, if so, cutting through the linkage portion to electrically separate the exposure portion from the intersection portion and the rail.

49. A method as in claim 48 wherein the cutting act entails directing light energy on the linkage portion.

50. A method as in claim 48 wherein the providing act includes furnishing the control electrode with a further rail extending longitudinally generally in the second lateral direction such that the intersection portion is continuous with, and extends laterally away from, the further rail so as to be partly located between the rails, the method further including:

examining the structure to determine whether the control electrode appears to be electrically short circuited to the emitter electrode at a segment of one of the rails; and, if so, cutting through the short-circuited rail on opposite sides of the short-circuited segment to electrically separate it from the remainder of the control electrode.

51. A method of performing corrective test on an electron-emitting device in which an emitter electrode extends longitudinally generally in a first lateral direction, an electron-emissive region comprises a main electron-emissive zone that contains a multiplicity of electron-emissive elements situated over part of the emitter electrode, and a control electrode comprises (a) a primary rail crossing over the emitter electrode and extending longitudinally generally in a second lateral direction different from the first lateral direction, (b) a major intersection portion continuous with, and extending laterally away from, the rail, (c) a main exposure portion largely overlying the electron-emissive zone and having a multiplicity of openings through which the electron-emissive elements are exposed, and (d) a major linkage portion extending between the intersection and exposure portions, the method comprising:

examining the device to determine whether the control electrode appears to be electrically short circuited to the emitter electrode at the exposure portion; and, if so, cutting through the linkage portion to electrically separate the exposure portion from the intersection portion and the rail.

52. A method as in claim 51 wherein at least part of the linkage portion is lateral to the emitter electrode.

53. A method as in claim 51 wherein the cutting act entails directing light energy on the linkage portion.

54. A method as in claim 53 wherein the light energy is directed on the linkage portion from above the control electrode.

55. A method as in claim 53 wherein the light energy is directed on the linkage portion from below the control electrode.

56. A method as in claim 51 further including assembling the electron-emitting device and a light-emitting device to form a display, the cutting act being performed subsequent to the assembling act.

57. A method as in claim 56 wherein the cutting act entails directing light energy on the linkage portion from below the control electrode.

58. A method as in claim 51 further including assembling the electron-emitting device and a light-emitting device to form a display, the cutting act being performed prior to the assembling act by directing light energy on the linkage portion.

59. A method as in claim 51 wherein the control electrode includes (a) a further intersection portion continuous with, and extending laterally away from, the rail and (b) a further linkage portion extending between the further intersection portion and the exposure portion, the cutting act further including, if the control electrode appears to be electrically short circuited to the emitter electrode at the exposure portion, cutting through the further linkage portion.

60. A method as in claim 51 wherein the control electrode includes a further rail extending longitudinally generally in a second lateral direction such that the intersection portion is continuous with, and extends laterally away from, the further rail so as to be at least partly located between the rails, the method further including:

examining the device to determine whether the control electrode appears to be electrically short circuited to the emitter electrode at a segment of one of the rails; and, if so, cutting through the short-circuited rail on opposite sides of the short-circuited segment to electrically separate it from the remainder of the control electrode.

61. A method as in claim 60 wherein the act of cutting through the short-circuited rail comprises cutting through the rail at a pair of locations lateral to the emitter electrode.

62. A method as in claim 60 wherein the act of cutting through the short-circuited rail entails directing light energy on the short-circuited rail.

63. A method comprising providing a structure in which an emitter electrode comprises (a) a primary rail extending longitudinally generally in a first lateral direction, (b) a major intersection portion continuous with, and extending laterally away from, the rail, (c) a main emitter-coupling portion, and (d) a main linkage portion extending between the intersection and emitter-coupling portions, an electron-emissive region comprises a main electron-emissive zone that contains a main electron-emissive element situated over the emitter-coupling portion, and a control electrode overlies the electron-emissive zone, has an opening through which the electron-emissive element is exposed, crosses over the rail, and extends longitudinally generally in a second lateral direction different from the first lateral direction.

64. A method as in claim 63 wherein at least part of the linkage portion is lateral to the control electrode.

65. A method as in claim 63 wherein:

the emitter electrode includes a further rail extending longitudinally generally in the first lateral direction; and the intersection portion is continuous with, and extends laterally away from, the further rail so as to be at least partly located between the rails.

66. A method as in claim 63 further including:

examining the structure to determine whether the emitter electrode appears to be electrically short-circuited to the control electrode at the emitter-coupling portion; and, if so, cutting through the linkage portion to electrically separate the emitter-coupling portion from the intersection portion and the rail.

67. A method as in claim 66 wherein the providing act includes furnishing the emitter electrode with a further rail extending longitudinally generally in the first lateral direction such that the intersection portion is continuous with, and extends laterally away from, the further rail so as to be at least partly located between the rails, the method further including:

examining the structure to determine whether the emitter electrode appears to be electrically short circuited to the control electrode at a segment of one of the rails; and, if so, cutting through the short-circuited rail on opposite sides of the short-circuited segment to electrically separate it from the remainder of the emitter electrode.

68. A method of performing corrective test on an electron-emitting device in which an emitter electrode comprises (a) a primary rail extending longitudinally generally in a first lateral direction, (b) a major intersection portion continuous with, and extending laterally away from, the rail, (c) a main emitter-coupling portion, and (d) a main linkage portion extending between the intersection and emitter-coupling portions, an electron-emissive region comprises a main electron-emissive zone that contains a main electron-emissive element situated over the emitter-coupling portion, and a control electrode overlies the electron-emissive zone, has an opening through which the electron-emissive element is exposed, crosses over the rail, and extends longitudinally generally in a second lateral direction different from the first lateral direction, the method comprising:

examining the device to determine whether the emitter electrode appears to be electrically short circuited to the control electrode at the emitter-coupling portion; and, if so, cutting through the linkage portion to electrically separate the emitter-coupling portion from the intersection portion and the rail.

69. A method as in claim 68 wherein at least part of the linkage portion is lateral to the control electrode.

70. A method as in claim 68 wherein the cutting act entails directing light energy on the linkage portion.

71. A method as in claim 68 further including assembling the electron-emitting device and a light-emitting device to form a display, the cutting act being performed subsequent to the assembling act.

72. A method as in claim 68 wherein the providing act includes furnishing the emitter electrode with a further rail extending longitudinally generally in the first lateral direction such that the intersection portion is continuous with, and extends laterally away from, the further rail so as to be at least partly located between the rails, the method further including:

examining the device to determine whether the emitter electrode appears to be electrically short circuited to the control electrode at a segment of one of the rails; and, if so, cutting through the short-circuited rail on opposite sides of the short-circuited segment to electrically separate it from the remainder of the emitter electrode.

* * * * *